US010378538B2

(12) United States Patent
Blume

(10) Patent No.: US 10,378,538 B2
(45) Date of Patent: Aug. 13, 2019

(54) FLUID END AND CENTER FEED SUCTION MANIFOLD

(71) Applicant: George H Blume, Austin, TX (US)

(72) Inventor: George H Blume, Austin, TX (US)

( * ) Notice: Subject to any disclaimer, the term of this patent is extended or adjusted under 35 U.S.C. 154(b) by 282 days.

(21) Appl. No.: 15/530,010

(22) Filed: Nov. 17, 2016

(65) Prior Publication Data

US 2018/0135621 A1 May 17, 2018

Related U.S. Application Data

(63) Continuation-in-part of application No. 14/078,366, filed on Nov. 12, 2013, now Pat. No. 9,500,195.

(60) Provisional application No. 61/727,289, filed on Nov. 16, 2012.

(51) Int. Cl.

| | |
|---|---|
| ***F04B 53/16*** | (2006.01) |
| ***F04B 53/10*** | (2006.01) |
| ***F04B 1/00*** | (2006.01) |
| ***F04B 19/22*** | (2006.01) |
| *F04B 1/04* | (2006.01) |
| *F04B 1/053* | (2006.01) |

(52) U.S. Cl.

CPC ..... *F04B 53/16* (2013.01); *F04B 1/00* (2013.01); *F04B 53/10* (2013.01); *F04B 1/0404* (2013.01); *F04B 1/0408* (2013.01); *F04B 1/0421* (2013.01); *F04B 1/0461* (2013.01); *F04B 1/053* (2013.01); *F04B 1/0538* (2013.01); *F04B 19/22* (2013.01)

(58) Field of Classification Search

CPC ..... F04B 53/16; F04B 53/10; F04B 53/22; F04B 1/0538; F04B 1/053; F04B 1/0461; F04B 1/0421; F04B 1/0404; F04B 1/00; F04B 1/04; F04B 19/22; F16L 41/02; F16L 41/03

See application file for complete search history.

(56) References Cited

U.S. PATENT DOCUMENTS

| | | | | |
|---|---|---|---|---|
| 4,878,815 | A * | 11/1989 | Stachowiak | F04B 53/1025 417/63 |
| 6,629,828 | B1 * | 10/2003 | Johansson | F04B 53/16 285/368 |
| 7,484,452 | B2 * | 2/2009 | Baxter | F04B 39/10 417/539 |
| 9,441,776 | B2 * | 9/2016 | Byrne | F04B 11/0008 |
| 9,500,195 | B2 * | 11/2016 | Blume | F04B 53/10 |
| D779,559 | S * | 2/2017 | Micken | D15/5 |
| 9,745,968 | B2 * | 8/2017 | Kotapish | F04B 53/16 |
| 9,945,362 | B2 * | 4/2018 | Skurdalsvold | F04B 1/00 |

(Continued)

FOREIGN PATENT DOCUMENTS

JP 10159665 A * 6/1998

*Primary Examiner* — Nathan C Zollinger
(74) *Attorney, Agent, or Firm* — Gary W. Hamilton

(57) ABSTRACT

A fluid end assembly comprising: a housing, valves, seals, seats, springs, plungers, plunger packing, and other associated parts, paired with a suction manifold that facilitates fluid feeding through a centrally located external suction intake. The suction manifold of this invention is designed to preserve fluid energy that will ensure complete filling of the cylinder in extreme pumping conditions. The suction manifold utilizes a chamber design positioned immediately below the suction valves, eliminating all connecting ducts. The design of the manifold of this invention can be easily fabricated utilizing commercially available steel plate, pipe, and pipe fittings.

15 Claims, 25 Drawing Sheets

(56) References Cited

U.S. PATENT DOCUMENTS

| | | | | |
|---|---|---|---|---|
| 10,113,679 | B2 * | 10/2018 | Shuck | E21B 43/26 |
| 2003/0235508 | A1 * | 12/2003 | Vicars | F04B 53/007 417/360 |
| 2010/0322803 | A1 * | 12/2010 | Small | F04B 53/16 417/454 |
| 2016/0230510 | A1 * | 8/2016 | Micken | F04B 53/16 |

* cited by examiner

Section C-C of Figure 7B

Section D-D of Figure 7C

Enlarged Area "B-B" of Figure 9A

Section "C-C" of Figure 9A

Section "D-D" of Figure 10B

Section "E-E" of Figure 10B

Section "F-F" of Figure 10D

FLUID END AND CENTER FEED SUCTION MANIFOLD

RELATED APPLICATION DATA

This patent application is a CIP and claims priority to patent application Ser. No. 14/078,366, filed on Nov. 12, 2013, which, by this reference is incorporated for all purposes.

FIELD OF THE INVENTION

The invention generally concerns high-pressure plunger-type pumps useful, for example, in oil well hydraulic fracturing. More specifically, the invention relates to pump suction manifolds designed to properly feed suction valves utilized in rapid open-close cycling when pumping abrasive fluids, such as sand slurries at high pressures.

BACKGROUND OF THE INVENTION

Engineers typically design high-pressure oil field plunger pumps in two sections; the (proximal) power section and the (distal) fluid section which are connected by multiple stay-rods. In the fracturing industry and hereafter in this application these sections are referred to as the power end and the fluid end. The power end, illustrated in FIG. 1, usually comprises a crankshaft, reduction gears, bearings, connecting rods, crossheads, crosshead extension rods, etc. Commonly used fluid ends usually comprise a plunger pump housing having a suction valve in a suction valve bore, a discharge valve in a discharge valve bore, an access bore, and a plunger in a plunger bore, plus high-pressure seals, retainers, etc. FIG. 1 illustrates a typical fluid end showing its connection to a power end by stay rods. A plurality of plungers similar to that illustrated in FIG. 2A may be combined, as suggested in the Quini-plex or five plunger fluid end housing illustrated in FIGS. 2A and 3B. Fluid ends also include a suction manifold to supply fluid to the suction valve bore, suction seat, and suction valve. The suction manifold is typically attached to the fluid end by bolts. The suction manifold is typically connected to an external suction feed hose used to supply fluid to the manifold by a tubular connection on either end of the suction manifold. The discharge manifold which allows for the exit of the pumped high pressure fluid is usually integral to the fluid end.

Valve terminology varies according to the industry (e.g., pipeline or oil field service) in which the valve is used. In some applications, the term "valve" means just the valve body, which reversibly seals against the valve seat. In other applications, the term "valve" includes components in addition to the valve body, such as the valve seat and the housing that contains the valve body and valve seat. A valve as described herein comprises a valve body and a corresponding valve seat, the valve body typically incorporating an elastomeric seal within a peripheral seal retention groove.

Valves can be mounted in the fluid end of a high-pressure pump incorporating positive displacement pistons or plungers in plunger bores. Such valves typically experience high pressures and repetitive impact loading of the valve body and valve seat. These severe operating conditions have in the past often resulted in leakage and/or premature valve failure due to metal wear and fatigue. In overcoming such failure modes, special attention is focused on valve sealing surfaces (contact areas) where the valve body contacts the valve seat intermittently for reversibly blocking fluid flow through a valve.

Valve sealing surfaces are subject to exceptionally harsh conditions in exploring and drilling for oil and gas, as well as in their production. For example, producers often must resort to "enhanced recovery" methods to insure that an oil well is producing at a rate that is profitable. And one of the most common methods of enhancing recovery from an oil well is known as fracturing. During fracturing, cracks are created in the rock of an oil bearing formation by application of high hydraulic pressure. Immediately following fracturing, a slurry comprising sand and/or other particulate material is pumped into the cracks under high pressure so they will remain propped open after hydraulic pressure is released from the well. With the cracks thus held open, the flow of oil through the rock formation toward the well is usually increased.

The industry term for particulate material in the slurry used to prop open the cracks created by fracturing is the proppant. And in cases of very high pressures within a rock formation, proppant may comprise extremely small aluminum oxide spheres instead of sand. Aluminum oxide spheres may be preferred because their spherical shape gives them higher compressive strength than angular sand grains. Such high compressive strength is needed to withstand pressures tending to close cracks that were opened by fracturing. Unfortunately, both sand and aluminum oxide slurries are very abrasive, typically causing rapid wear of many component parts in the positive displacement plunger pumps through which they flow. Accelerated wear is particularly noticeable in plunger seals and in the suction (i.e., intake) and discharge valves of these pumps.

Back pressure tends to close each individual valve sequentially when downstream pressure exceeds upstream pressure. For example, back pressure is present on the suction valve during the pump plunger's pressure stroke (i.e., when internal pump pressure becomes higher than the pressure of the intake slurry stream. During each pressure stroke, when the intake slurry stream is thus blocked by a closed suction valve, internal pump pressure rises and slurry is discharged from the pump through a discharge valve. For a discharge valve, back pressure tending to close the valve arises whenever downstream pressure in the slurry stream (which remains relatively high) becomes greater than internal pump pressure (which is briefly reduced each time the pump plunger is withdrawn as more slurry is sucked into the pump through the open suction valve).

The suction manifold plays a vital role in the smooth operation of the pump and valve performance and life. All fluid entering the pump passes through the suction manifold. If the suction manifold is poorly designed, incomplete filling of the plunger bore may result, which in turn leads to valves closing well after the end of the suction stroke, which in turn results in higher valve impact loads. High valve impact loads in turn result in high stress in the fluid end housing and ultimate premature failure of the valves, seats, and/or housing.

To insure complete filling of the plunger bore requires fluid energy in the suction manifold and fluid energy in the plunger bore during the suction stroke. The pumped fluid typically acquires fluid energy from the fluid pressure from a small supercharging pump immediately upstream from the pump of this invention. The fluid energy can be dissipated by turbulence or friction within the suction filling plumbing or line and in the suction manifold. Thus the design of the suction manifold is critical to maintaining fluid energy.

Fracturing pumps typically pump a very heavy and viscous fluid as the fluid is composed of heavy sand suspended in a gel type fluid. With this type of fluid it is very easy to lose fluid energy to friction and/or turbulence.

A traditional design Suction Manifold is illustrated in FIGS. 2A and 2B. The fluid end sectional view of FIG. 2B is defined in FIG. 2A. An alternate sectional view at a right angle to the sectional view of FIG. 2B is illustrated in FIG. 3B; this sectional view is defined in FIG. 3A. Sharp corners at the intersection of the horizontal main chamber and the vertical suction valve feed ducts result in turbulence and loss of fluid energy.

Zoomie style suction manifolds illustrated in FIGS. 4 and 5, have gained some acceptance in the industry. By intuition, it is incorrectly assumed that the long sweep ell style ducts reduce turbulence and that the flow in the manifold is uni-directional. However because each suction valve opens and closes at different intervals, flow is actually interrupted when the valve is closed. Furthermore flow is reversed momentarily as the valve closes. When flow reverses, turbulence is generated at the sharp corner positioned at the intersection of the main suction manifold chamber and the ell that functions as a duct for feeding the corresponding suction valve. When the flow stops in a portion of the manifold, some fluid energy is lost and fluid energy is expended to resume flow when the suction valve opens. In addition there is considerable frictional loss in the long sweep ell ducts that the pumped fluid must travel through resulting in even greater loss of fluid energy within the Zoomie style suction manifold.

All the previously discussed manifolds, FIGS. 1-5, plus the manifold of the reference application Ser. No. 14/078,366, lose fluid energy because of the frictional loss and turbulence due to the distance that the fluid must travel from the external connection, previously referred to as the tubular connection, is located at either end of the suction manifold. Thus there is greater frictional loss of fluid energy in the ducts located at the farthest distance from the external connection. This loss of fluid energy can result in incomplete filling of the plunger bore farthermost from the suction manifold external connection, which can result is impact loading of the valve against the seat as previously discussed.

Ideally, the external connection to a pump suction manifold would be centrally located on the manifold in order to reduce the fluid travel and friction loss at each manifold port. The location of the external connection at either end of the suction manifold is usually, dictated by the mounting of these high-pressure plunger-type pumps on the tractor truck trailers necessary for these pumps to be moved from one oilwell location to another location after each and every fracturing operation. These trailers are usually parked side-by-side on a job site because of the limited available space for all the equipment necessary to successfully fracture an oilwell. All of these factors combine to influence the location of the external connection of manifolds of the prior art because of limited space between the bottom of the suction manifold and the deck of the trailer. Additionally, the tight parking at the job site may result in complications including tight, restricting bends in the external suction feed hose used to supply fluid to the suction manifold through the external intake connection, particularity if a centrally located external connection is positioned at a right angle to the manifold chamber.

Thus, by default, suction manifolds of the prior art for oilfield high-pressure plunger-type pumps on tractor truck trailers are designed with external connections at either end of the manifolds. However, for oilfield mud pumps which are skid mounted (rather than truck mounted) without space limitations, center feed external intake connections on the suction manifolds are somewhat common as shown in FIGS. 6A&B and FIGS. 7A, B, C, & D. The suction manifold of FIGS. 6A&B is an improved design with smooth slow bends that minimize fluid energy loss. Unfortunately these manifolds can only be manufactured from steel castings. Manifold castings require separate patterns for each individual pump models because the various and many pump models have different configurations including but not limited to the number of plungers (usually 3-5 plungers) and various spacing that include 8, 9, 10, 10.5 & 12 inch spacing between the plungers. Therefore, tooling and raw material inventory to satisfy each and every configuration is extensive and expensive.

FIGS. 7A-D illustrate a mud pump model similar to the previously illustrated model in FIGS. 6A&B. The external connection of the latter manifold is also centrally located on the manifold, however this manifold is constructed by welding together various pieces of pipe. FIGS. 7C&D illustrate turbulence and fiction loss with this design due to the sharp corners at the welded pipe connections. As such, the suction manifold of FIGS. 7A-D offers limited improvement in performance as compared with the manifolds of the prior art in FIGS. 1-5. Neither of the suction manifolds illustrated in FIGS. 6A&B or 7A&B are suitable for utilization with high-pressure plunger-type pumps mounted on tractor trailers such as fracturing trucks because of space limitations.

Ideally, the centerline of a center feed external intake connection on a suction manifold would be aligned and parallel with the centerline of the center-most suction bore of the fluid end housing. When the centerlines are aligned the flow is uninterrupted by changes in direction of the fluid flow eliminating any loss of fluid energy in the fluid. However for fracturing pumps mounted on trucks, the close proximity of the truck bed restricts such alignment because the limited space with such an alignment would result in kinks or sharp bends in the suction feed hose and further loss of fluid energy.

SUMMARY OF THE INVENTION

The present invention continues the integrated design approach utilized by the inventor in the previous patent application Ser. No. 14/078,366. The present invention, however, represents an improvement over the design in the aforementioned patent application because it utilizes an external suction intake connection that is centrally located on the manifold to ensure equalized fluid feed to each suction manifold port. The centralized external suction intake connection assists in maintaining high fluid energy in the suction manifold. High fluid energy is essential in maintaining complete filling of the plunger bore during the suction stroke. Incomplete filling of the plunger bore results in the suction valve closing well past the end of the suction stroke which, in turn, causes high valve impact loads and associated high stresses on the valve seat and fluid end.

The present invention utilizes a plenum style interior chamber manifold design without the ducts utilized in a traditional suction manifold. The suction manifold of the present invention allows for bi-directional flow in the manifold and significantly reduces friction and turbulence while maintaining fluid energy. In the plenum style interior chamber design of this invention, the entire suction manifold is located directly below the fluid end block, eliminating all vertical ducts used to feed the suction valves. The plenum style chamber design of the present invention replaces ducts with ports concentric with the suction valves and allows fluid to be fed directly to the suction valve. The plenum style interior chamber consists of opposing lateral branches that connect the opposite ports with the central external intake connection of the suction manifold. The suction manifold of the present invention is attached to the bottom of the fluid housing by bolts and a mounting flange located across the top of the chamber. The circumferential edges of the ductless ports have fillets with full radii equal to the thickness of the mounting flange. The radiused edge allows bi-direction flow in the manifold and eliminates turbulence at the suction manifold ports.

The present invention is designed with a low profile to insure ease of installation on pumps mounted on fracturing truck tractor trailers. The obtuse angle between the centerline of the external intake connection and the plane formed by the centerlines of the ports positions the manifold external intake connection in proper alignment and coupling with the external feed suction hose. Finally, the obtuse angle assures minimum flow disruption typical of the right angle connection typical of mud pump center feed suction manifolds.

For optimum performance, the manifold of the present invention is constructed with a large fillet at the intersection of external intake connection cylindrical section with the lateral arm sections of the plenum style interior chamber of the suction manifold. This large fillet eliminates turbulence at the corners associated with manifolds with central feed intake connections constructed with welded pipe pieces such as illustrated in FIGS. 7A-D.

For optimum performance, the external intake connection should be located as close to the central suction valve of the fluid end as possible as illustrated in FIG. 8 as opposed to a connection at either end of the manifold as illustrated in FIGS. 1, 2A, 3B, 4, & 5. Traditionally this design optimization has been achieved by utilizing a large casting to construct the manifold as illustrated in FIGS. 6A&B. Suction manifolds manufactured from castings offer smooth continuous flow characteristics. However suction manifold casting have associated cost penalties because of tooling and raw material inventory requirements for each and every pump plunger spacing configurations.

The present invention eliminates the need for multiple expensive casting patterns and proposes to make suction manifolds with a central feed intake connection aligned with the central port of the manifold from commonly available raw material. Commercially available standard steel "TEE" pipe fitting, standard pipe, and standard plate are cut or split into specific shaped pieces. The various pieces are then welded together to build different manifolds for various different pump models with variously different plunger spacing. These standard TEE's are formed with very generous radii at the TEE intersection, see FIGS. 10D and 11A. A very important step is splitting the TEE length wise at an angle from the plane formed by the centerline of the opposing pipe ends of the TEE and the centerline of the third pipe connection of the TEE. Additionally the angle of the split is important to retain the very desirable radii at the corners of the TEE. The manifold of this invention is then manufactured by welding together the split TEE piece and split standard pipe pieces and standard steel plate.

DETAILED DESCRIPTION OF THE DRAWINGS

Figure 1:
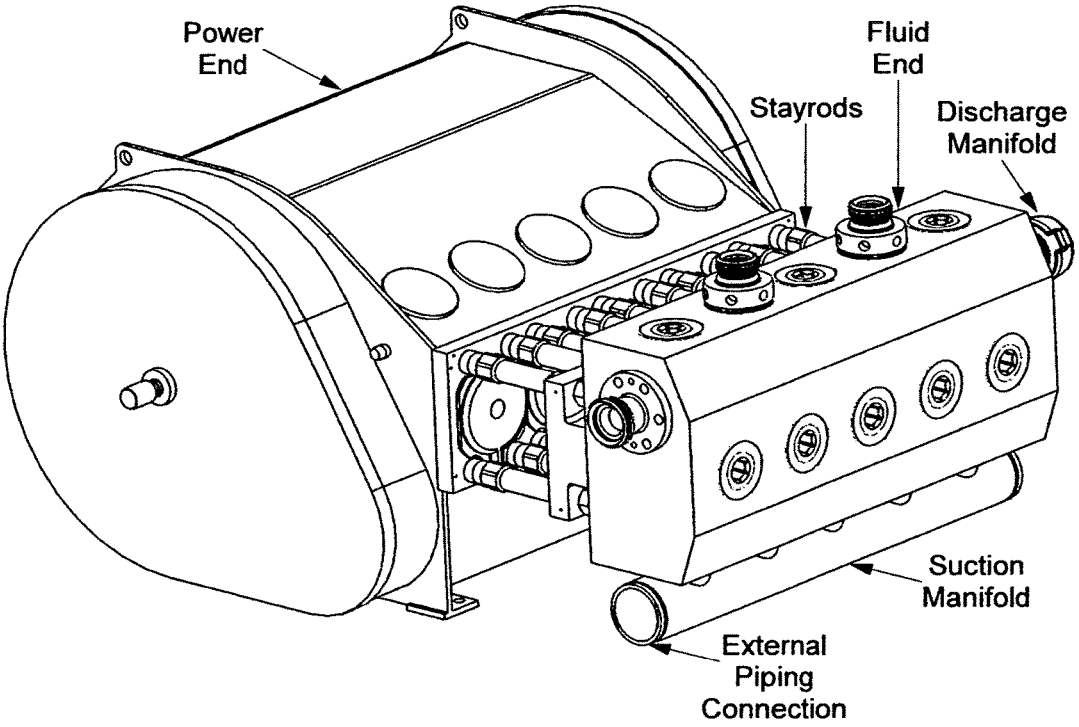
FIG. 1 is an exterior orthogonal view of a typical plunger pump showing the power end and the fluid end with the two ends connected by stay rods. A typical suction manifold is also illustrated.
Figure 2A:
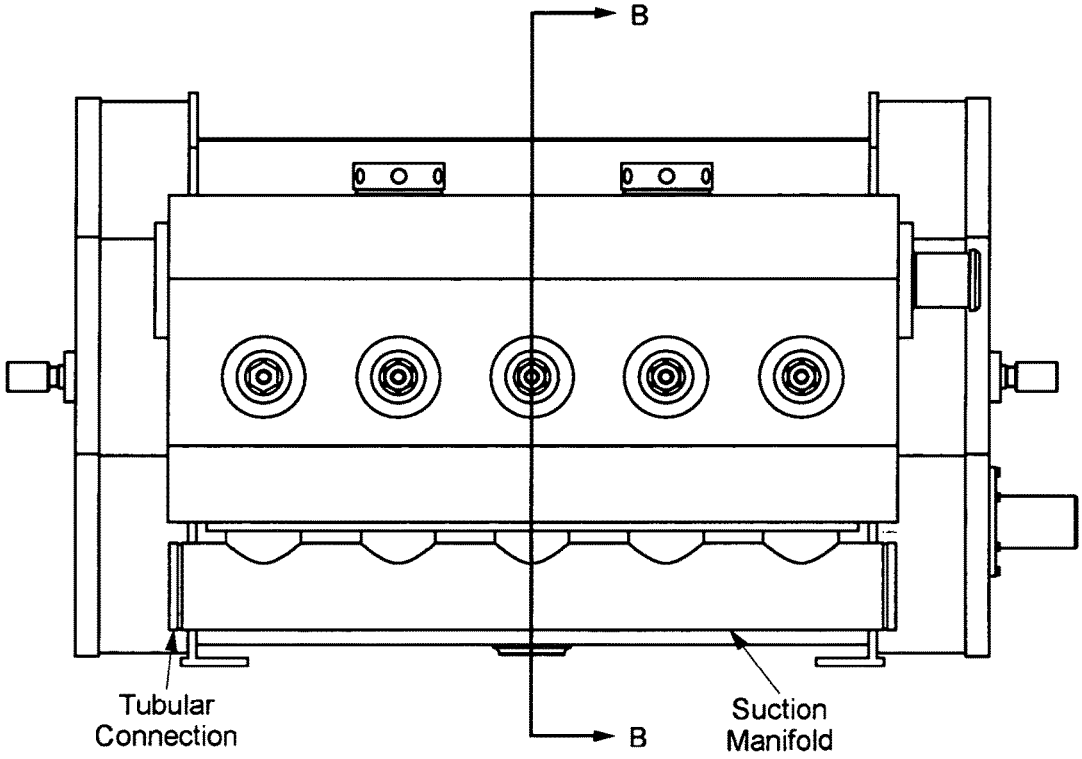
FIG. 2A is an exterior view of a typical plunger pump; this view is taken looking toward the fluid end and suction manifold of the pump.
Figure 2B:
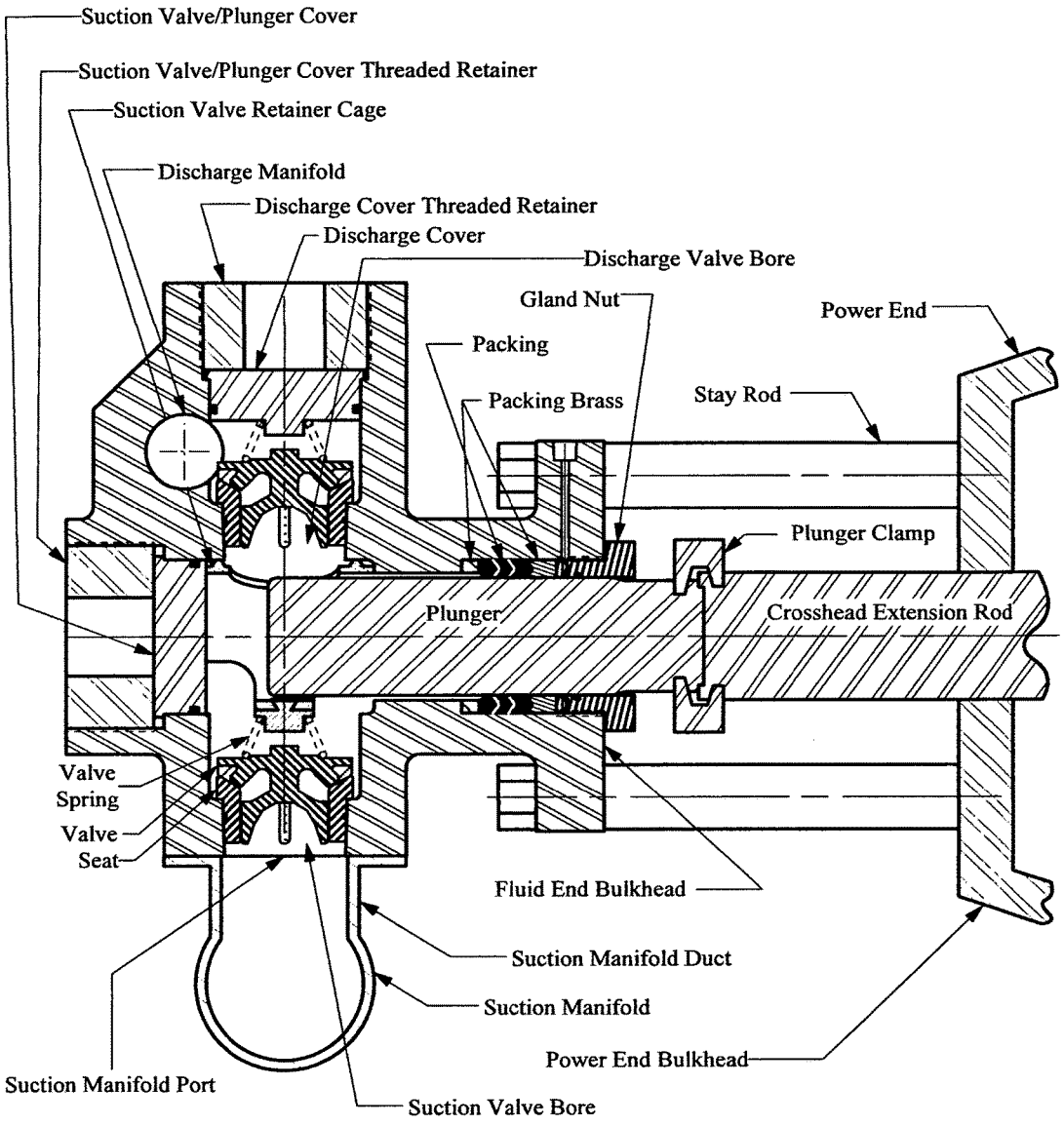
FIG. 2B schematically illustrates cross-section B-B of a typical high-pressure pump and suction manifold of FIG. 2A.
Figure 3A:
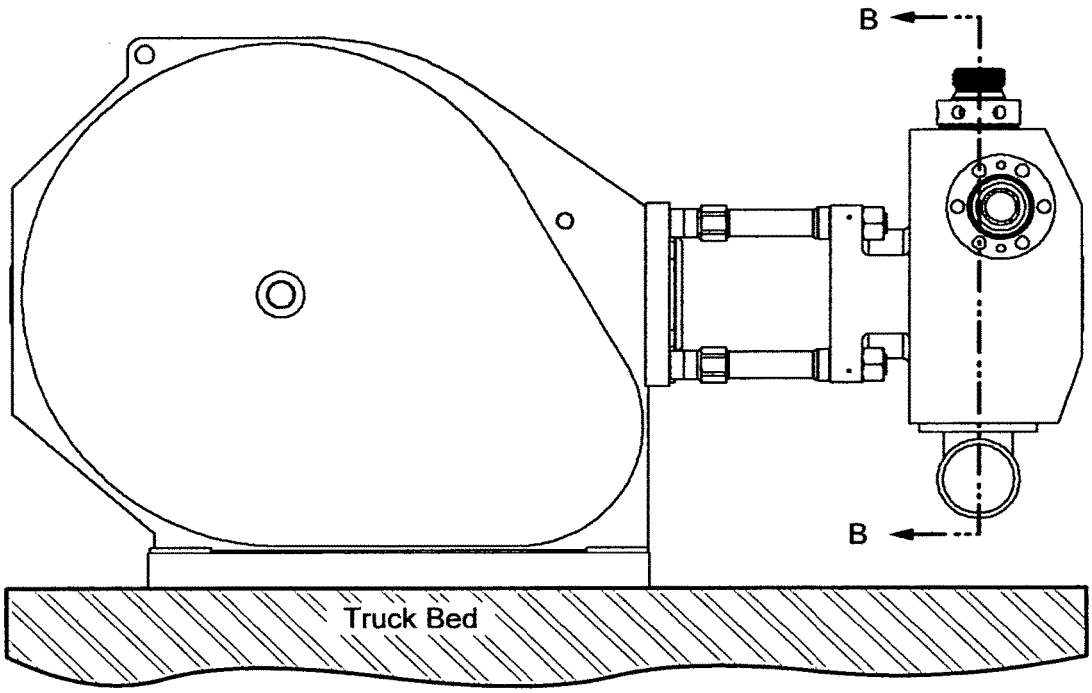
FIG. 3A is an exterior side view of a typical plunger pump.
Figure 3B:
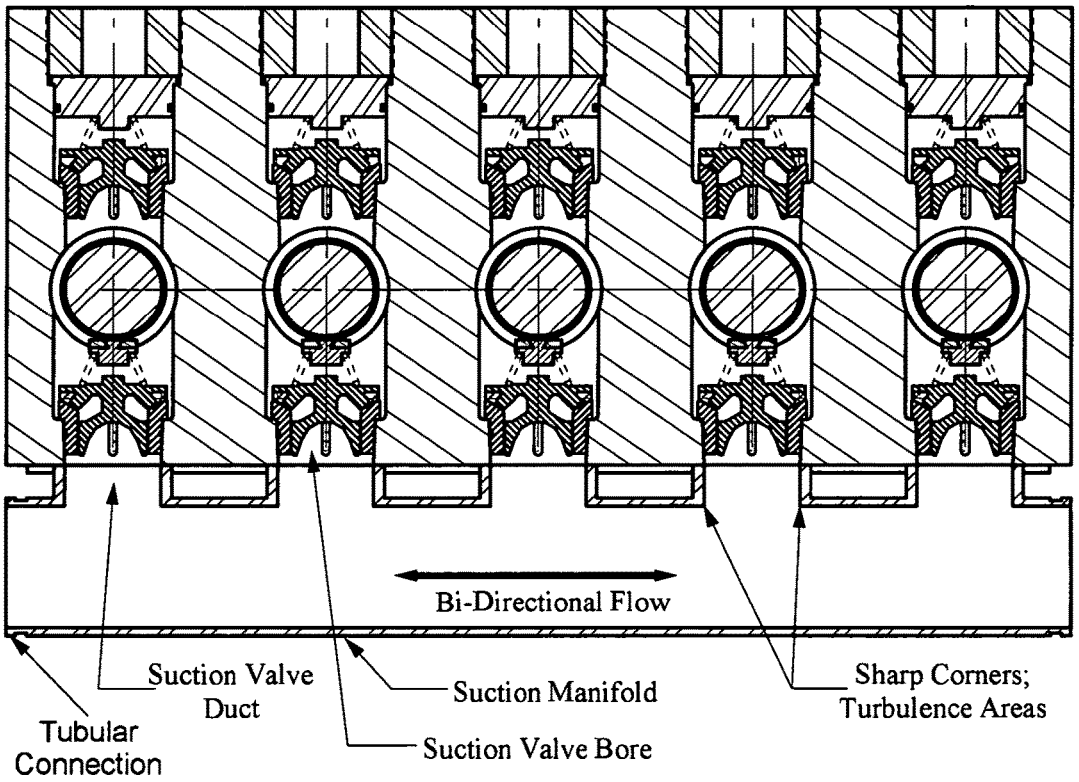
FIG. 3B schematically illustrates cross-section B-B of a typical high-pressure pump and suction manifold of FIG. 3A.
Figure 4:
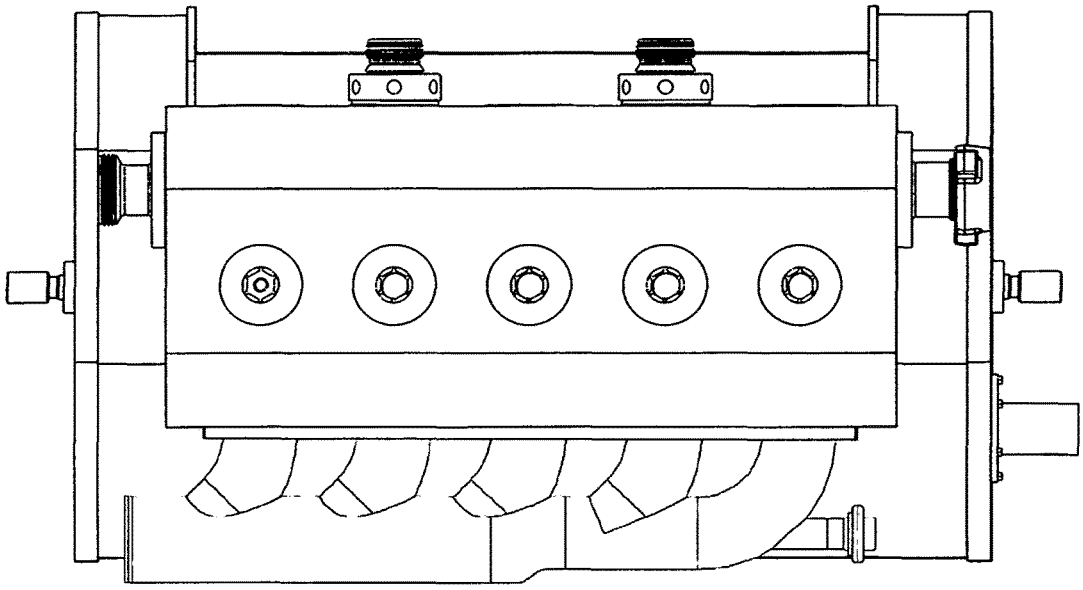
FIG. 4 schematically illustrates an end view from the fluid end of a typical high-pressure pump similar to view of FIG. 2A with the alternate Zoomie style suction manifold.
Figure 5:
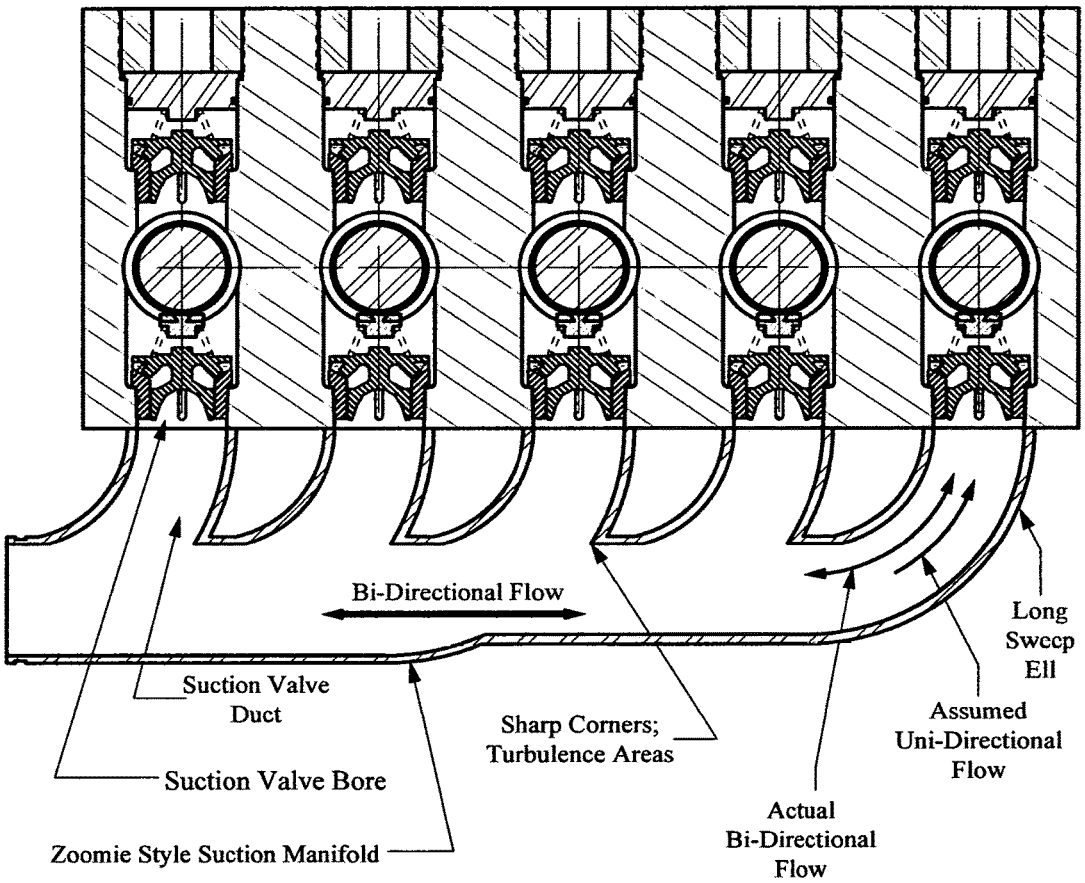
FIG. 5 schematically illustrates cross-section of a typical high-pressure pump and Zoomie style suction manifold of FIG. 4
Figure 6A:
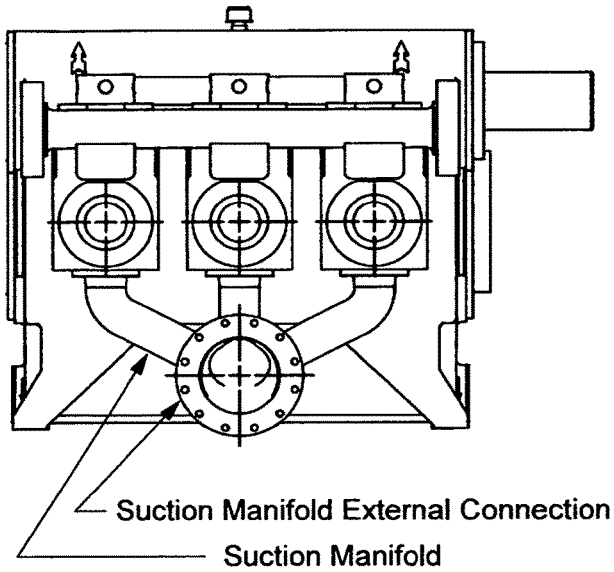
FIG. 6A schematically illustrates an end view of a typical mud pump with a centrally located external intake connection wherein the suction manifold is manufactured from a casting.
Figure 6B:
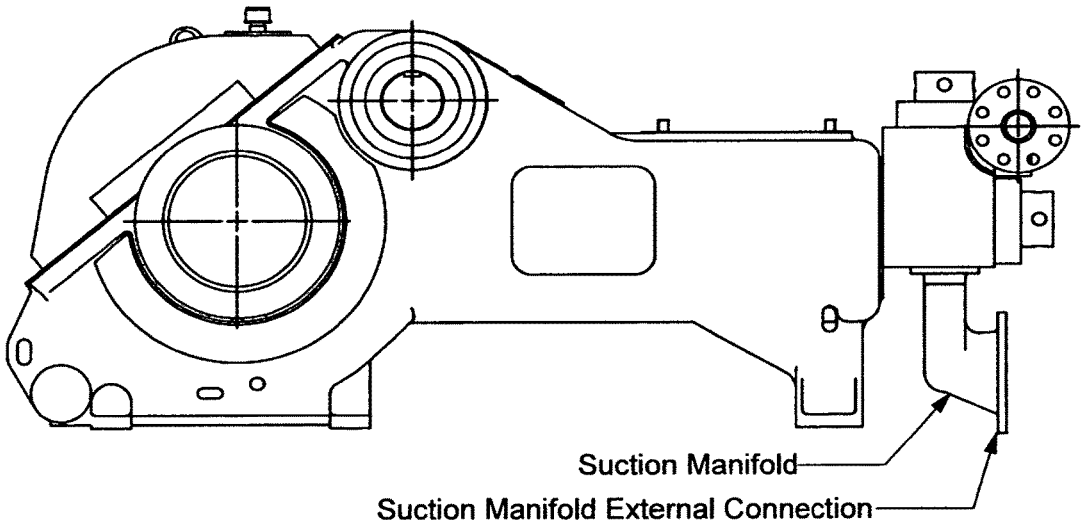
FIG. 6B schematically illustrates a side view of the typical mud pump and suction manifold FIG. 6A.
Figure 7A:
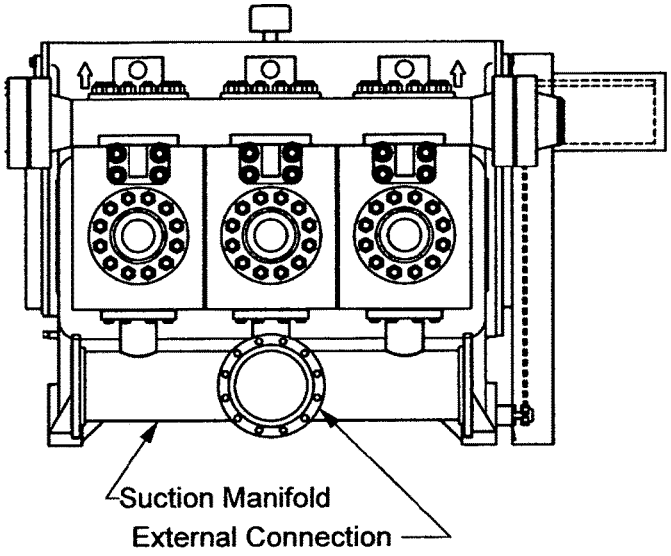
FIG. 7A schematically illustrates an end view of a typical mud pump with a centrally located external intake connection wherein the suction manifold is manufactured from welded pipe pieces.
Figure 7B:
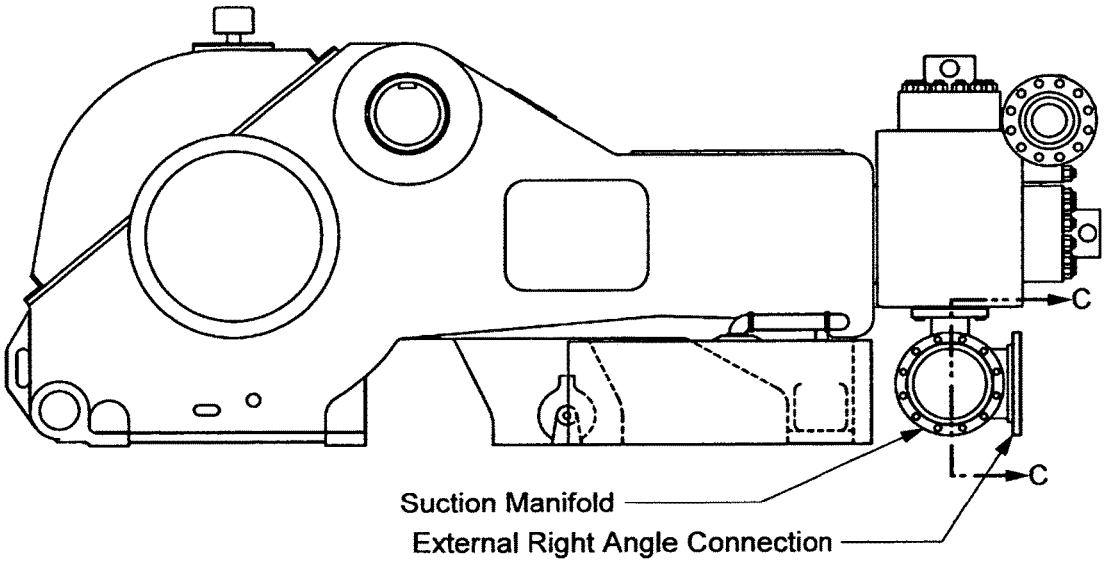
FIG. 7B schematically illustrates a side view of the typical mud pump and suction manifold FIG. 7A.
Figure 7C:
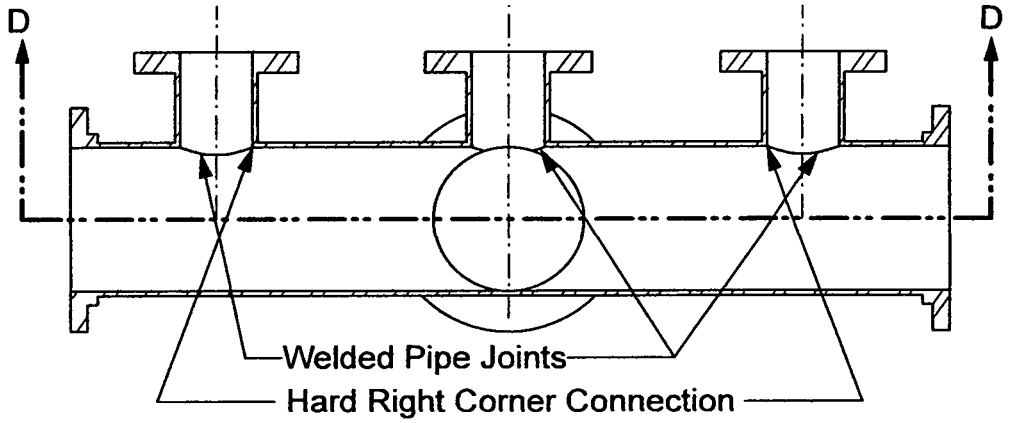
FIG. 7C schematically illustrates section C-C of the suction manifold of FIG. 7B.
Figure 7D:
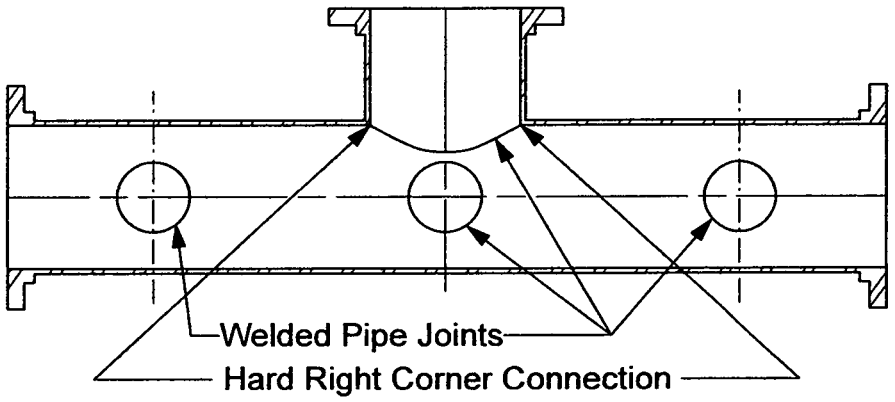
FIG. 7D schematically illustrates section D-D of FIG. 7C.
Figure 8:
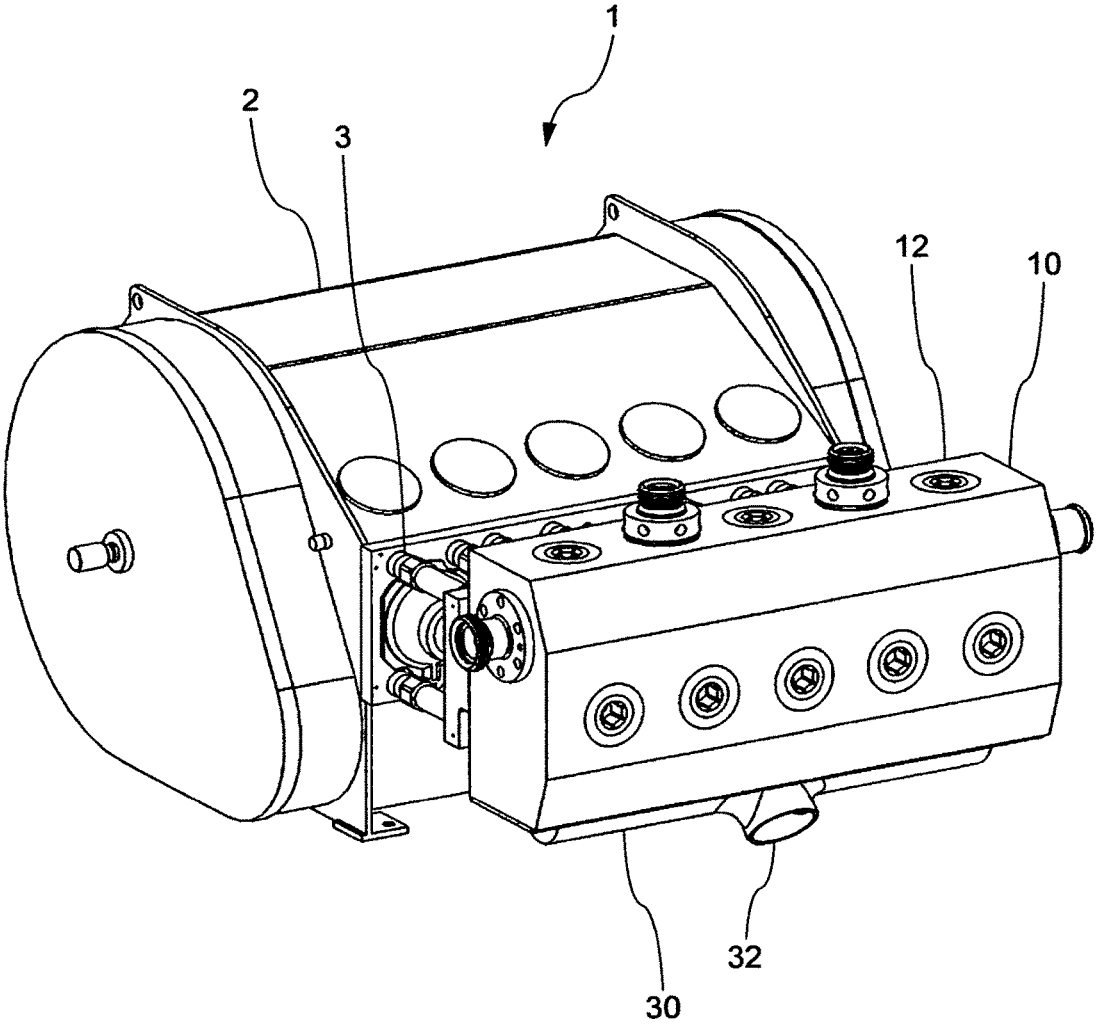
FIG. 8 schematically illustrates an orthogonal view of typical plunger pump similar to FIG. 1 with a suction manifold of the present invention with a centrally located external intake connection.

FIG. 8 illustrates a pump assembly 1 similar to the pump of FIG. 1, pump assembly 1 consists of a power end 2 and fluid end assembly 10 connected by stayrods 3. Fluid end assembly 10 consists of fluid end housing 12 and various internal components and external suction manifold 30 of this invention. Suction manifold 30 intakes fluid through a centrally located external intake connection 32.

Figure 9A:
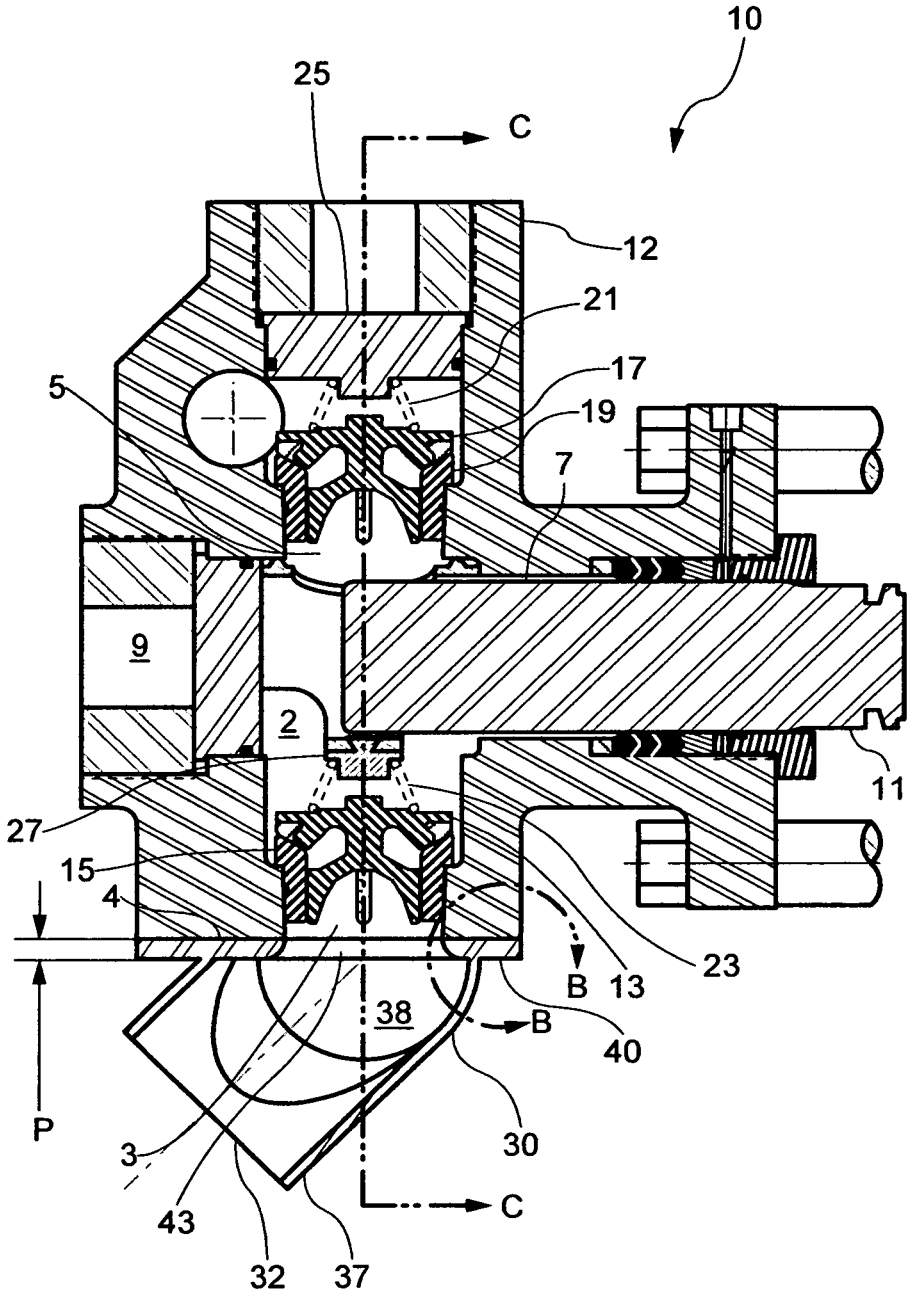
FIG. 9A schematically illustrates a cross-sectional view through one plunger of a fluid end of a typical high-pressure pump and the suction manifold of the present invention with a centrally located external intake connection.

FIG. 9A schematically illustrates a cross-sectional view through one plunger bore of a fluid end of a typical high-pressure pump and suction manifold of the present invention. The cross-section illustrated of pump fluid end 10 is defined by the axes of the suction valve bore 3, discharge bore 5, access bore 9, and plunger bore 7. FIG. 9A illustrates a plunger pump fluid end 10 made using a housing 12, and having suction valve bore 3, discharge valve bore 5, access bore 9, plunger bore 7, and inner volume 2. Suction valve 13, suction seat 15, suction valve spring 23, and suction valve spring retainer 27 reside in the suction valve bore 3. Discharge valve 17, discharge seat 19, discharge valve spring 21, discharge cover and spring retainer 25 reside in the discharge valve bore 5. The centerlines of the discharge valve bore and suction valve bore are substantially collinear according to some embodiments of the disclosure. Plunger 11 reciprocates back and forth within the plunger bore 7. In FIG. 9A the springs and retainers function to provide a mechanical bias to the suction valve and discharge valve, towards a closed position. FIG. 9A illustrates a suction manifold 30 with a centrally located external intake connection 32 of the present invention. Cylindrical surface 37 of external intake connection 32 is utilized to connect the suction manifold 30 to external piping with a corresponding cylindrical configuration utilized for supplying fluid to the pump fluid end 10. Suction manifold 30 also comprises a mounting flange 40 usually attached to the fluid end housing 12 with bolts (not shown.) Suction manifold mounting flange 40 mates with the bottom surface 4 of fluid end housing 12. Suction manifold mounting flange 40 has a thickness P. Suction manifold 30 also contains multiple ports 43 located concentric to corresponding suction valve 13 and suction seat 15. The number of ports in the suction manifold 30 is equal to the number of suction valves 13 in the pump fluid end 10. Suction manifold interior chamber 38 is utilized to distribute fluid to ports 43.

Figure 9B:
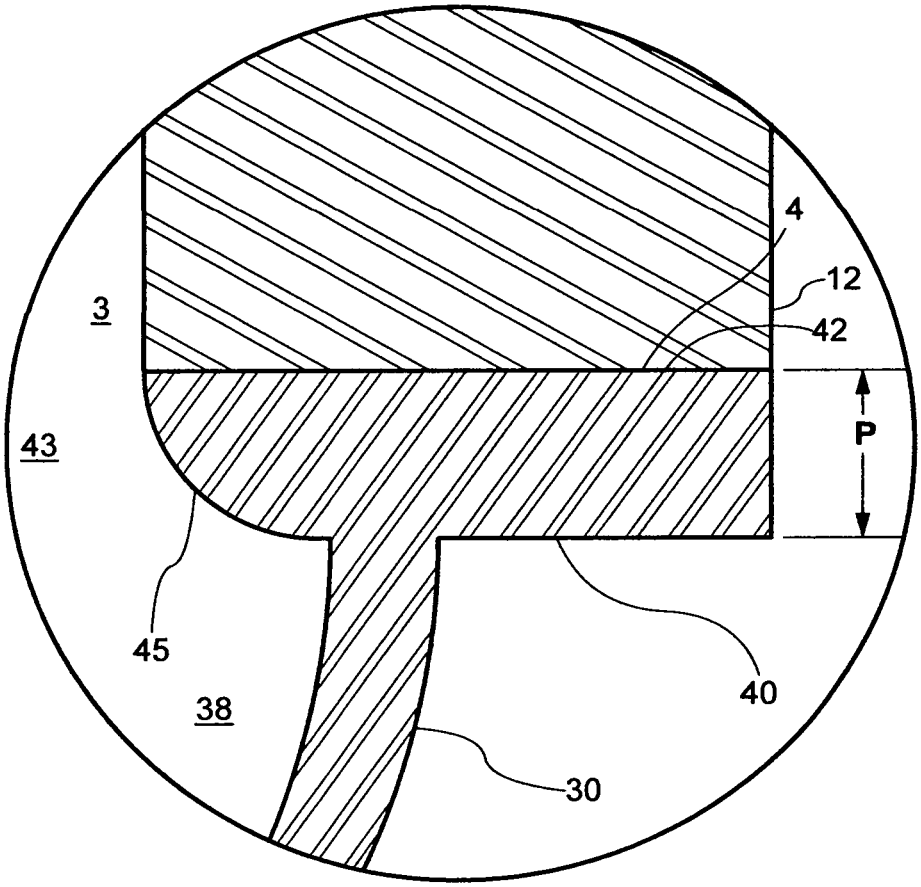
FIG. 9B schematically illustrates an enlargement of area B-B of a typical high-pressure pump and the suction manifold of FIG. 9A.

FIG. 9B schematically illustrates an enlargement of area B-B of the suction manifold 30 of FIG. 9A. Suction manifold 30 has mounting flange 40 and a port 43 to facilitate transfer of pumped fluid from the suction manifold interior chamber 38 into the suction valve bore 3 of fluid end housing 12 and then through the suction valve 13 and seat 15. Suction manifold interior chamber 38 is utilized to distribute fluid to ports 43. The circumferential edge of the port 43 is radiused with radius 45; radius 45 is approximately equal to thickness P mounting of flange 40. Top surface 42 of mounting flange 40 mates with bottom surface 4 of fluid end housing 12.

Figure 9C:
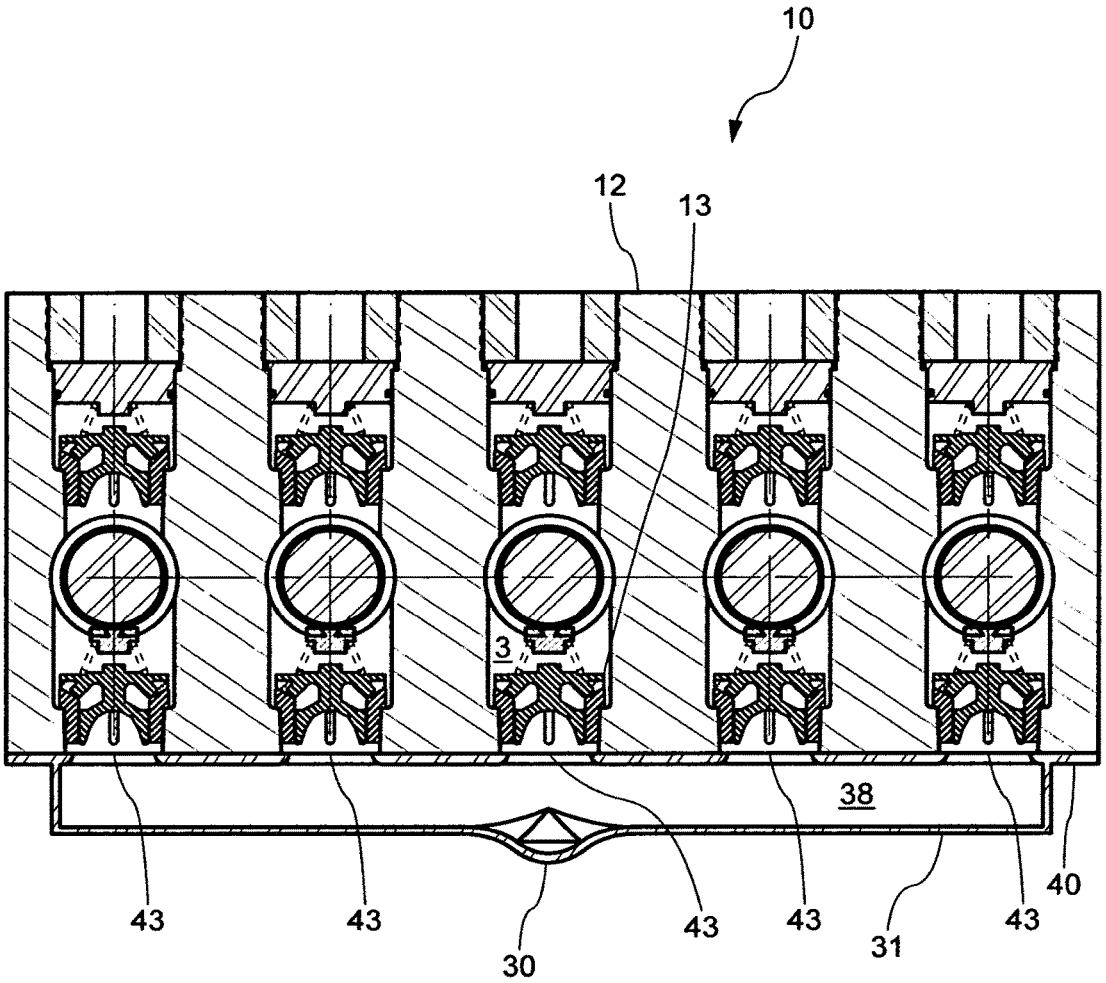
FIG. 9C schematically illustrates cross-section C-C of a typical high-pressure pump and the suction manifold of FIG. 9A.

FIG. 9C schematically illustrates cross-section C-C of the fluid end assembly 10 and suction manifold 30 of FIG. 9A, comprising exterior walls 31 of an undefined shape and a substantially tubular external intake connection 32 of FIG. 9A is located at equal distance from each of the farthermost ports 43 of the suction manifold 30. Tubular external intake connection 32 is utilized to connect the suction manifold 30 to external piping supplying fluid to the pump fluid end 10. Suction manifold 30 also comprises a mounting flange 40 usually attached to the fluid end housing 12 with bolts (not shown.) Suction manifold 30 also contains multiple ports 43 located concentric to corresponding suction valve bore 3. The number of ports in the suction manifold 30 is equal to the number of suction valves 13 in the pump fluid end. Suction manifold interior chamber 38 is utilized to distribute fluid to ports 43.

Figure 10A:
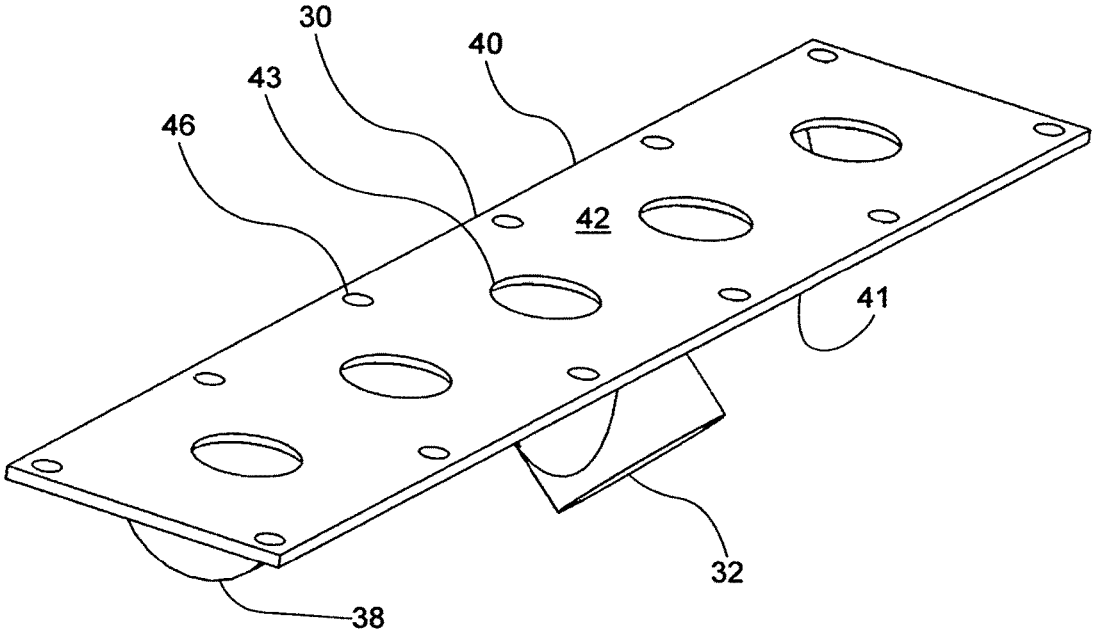
FIG. 10A schematically illustrates an orthogonal view of the suction manifold of the present invention.

FIG. 10A illustrates an orthogonal view of the suction manifold 30 of the present invention. Major structures of suction manifold 30 include mounting flange 40, external intake connection 32, and multiple ports 43 as previously described. Multiple bolt holes 46 in mounting flange 40 and an equal number of bolts (not shown) are utilized to secure mounting flange 40 of suction manifold 30 with the bottom of fluid end housing 12. Top surface 42 of mounting flange 40 mates with bottom surface 4 of fluid end housing 12. Bottom surface 41 of mounting flange 40 is integral with suction manifold lateral branches 36 & 35 as shown in FIG. 10C.

Figure 10B:
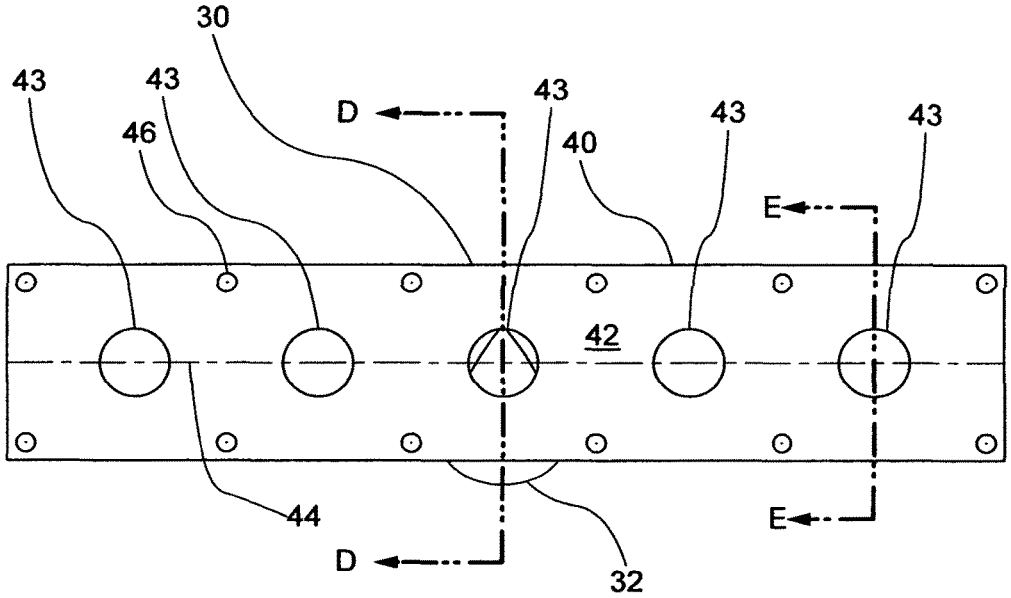
FIG. 10B schematically illustrates a top view of the suction manifold of FIG. 10A.

FIG. 10B illustrates a top view of the suction manifold 30 of the present invention. Also illustrated are mounting flange 40, top surface 42, bolt holes 46, external intake connection 32, and multiple ports 43; again illustrated as in FIG. 10A. Centerline 44 connects the center of all ports 43 in mounting flange 40.

Figure 10C:
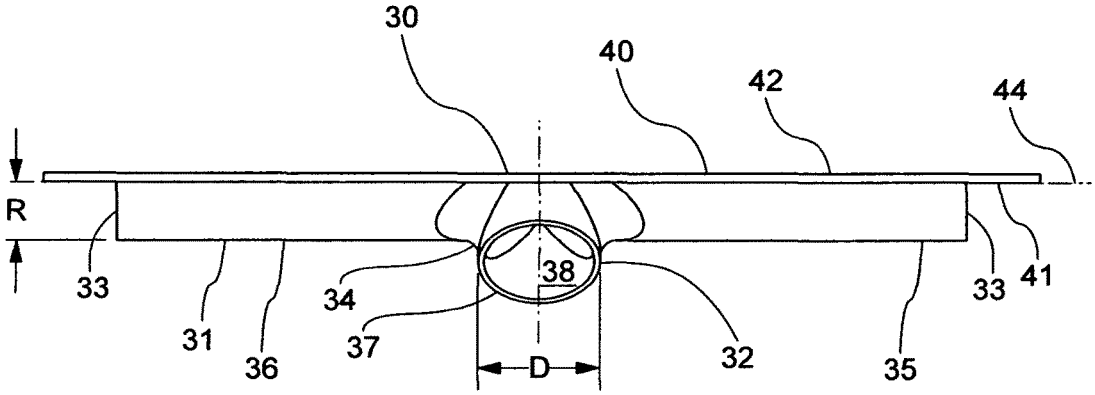
FIG. 10C schematically illustrates a frontal view of the suction manifold of FIG. 10B.

FIG. 10C illustrates a frontal view of the suction manifold 30 of FIGS. 10A&B. Suction manifold interior chamber 38 is composed of the interiors of external intake connection 32, left lateral 36, and right lateral 35. The intersection of the external intake connection 32 with laterals 35 and 36 is transitioned with fillet 34. Laterals 35 and 36 are substantially hemi-tubular in form with centerline 44 of said hemi-tubular sections 35 and 36 substantially flush with bottom surface 41 of mounting flange 40. Radius R is measured from centerline 44 to outside surface 31 of laterals 35 and 36. External intake connection 32 is substantially tubular in form having an outside cylindrical surface 37. Outside surface 37 diameter D of external intake connection 32 is approximately equal to two times radius R of hemi-tubular sections of laterals 35 and 36. The intersection of the laterals 35 and 36 with the external intake connection 32 results in irregular volume on the interior of fillet 34. End caps 33 close off the lateral branches 35 and 36 at opposing ends of interior chamber 38.

Figure 10D:
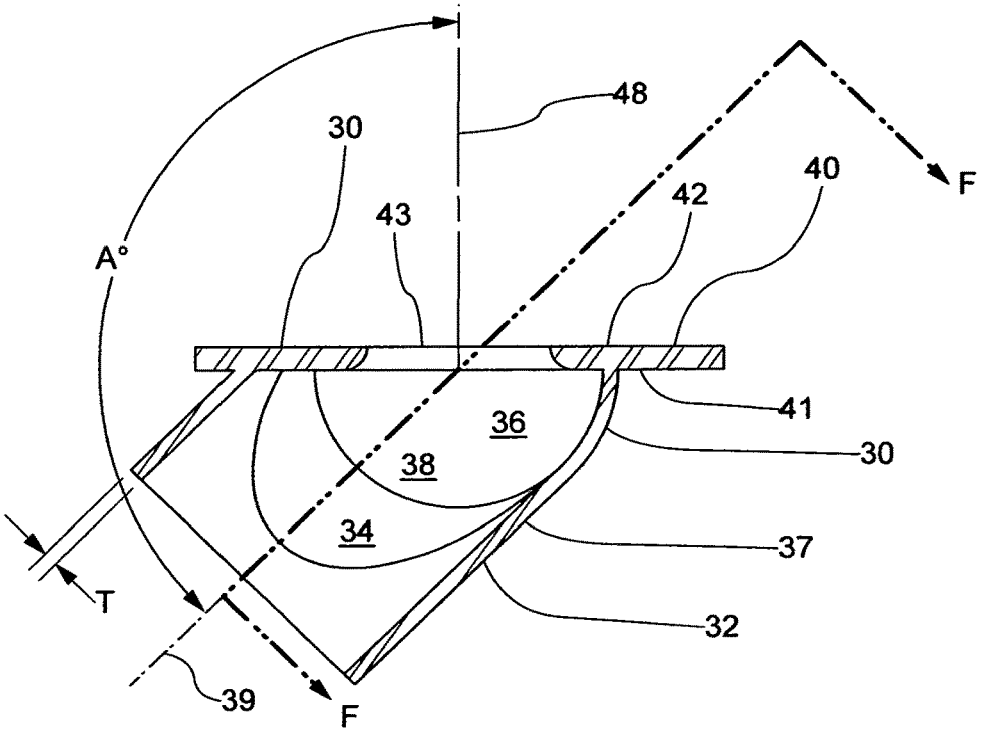
FIG. 10D schematically illustrates cross-section D-D of the suction manifold of FIG. 10B.
Figure 10E:
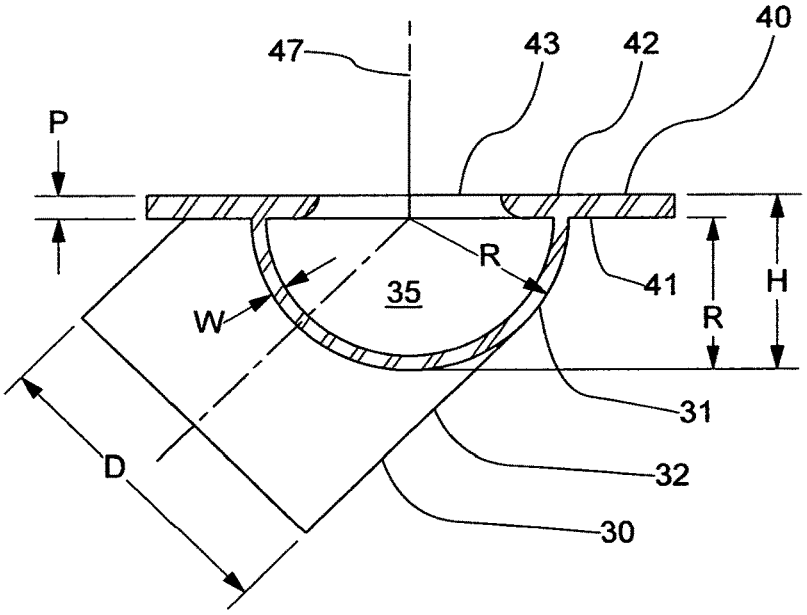
FIG. 10E schematically illustrates cross-section E-E of the suction manifold of FIG. 10B.

FIGS. 10D and 10E illustrate cross-section D-D and E-E, respectively, of FIG. 10B. Lateral branches 35 & 36 enclosing interior chamber 38 of suction manifold is joined to bottom surface 41 of mounting plate 40 of suction manifold 30. Interior chamber 38 includes interior volumes of external intake connection 32, lateral arm 36, lateral arm 35, multiple ports 43 and fillets 34. Exterior cylindrical surface 37 of external intake connection 32 joins with exterior surface 31 of hemi-tubular laterals 35 and 36 at fillet 34. Wall thickness T and W of tubular external intake connection 32 and hemi-tubular laterals 35 and 36 respectively are substantially equal. Centerlines 47 and 48 of multiple ports 43 form a plane perpendicular with the top and bottom surfaces 42 and 41 respectively of mounting flange 40. Tubular external intake connection 32 is defined by centerline 39. Centerlines 39 and 48 intersect at an obtuse angle A; centerline 39 also intersects a plane formed by centerlines 47 and 48 at the same obtuse angle A. Obtuse angle A, typically ranges in value between 120 and 160 degrees. Because radius R of hemi-cylindrical surface 31 is substantially equal to one half of diameter D of the cylindrical surface 37, profile height H of the suction manifold 30 measured from top surface 42 of the mounting plate 40 to the bottom surface 31 of the lateral branches 35 and 36 is less than the outside diameter D of external intake connection 32.

Figure 10F:
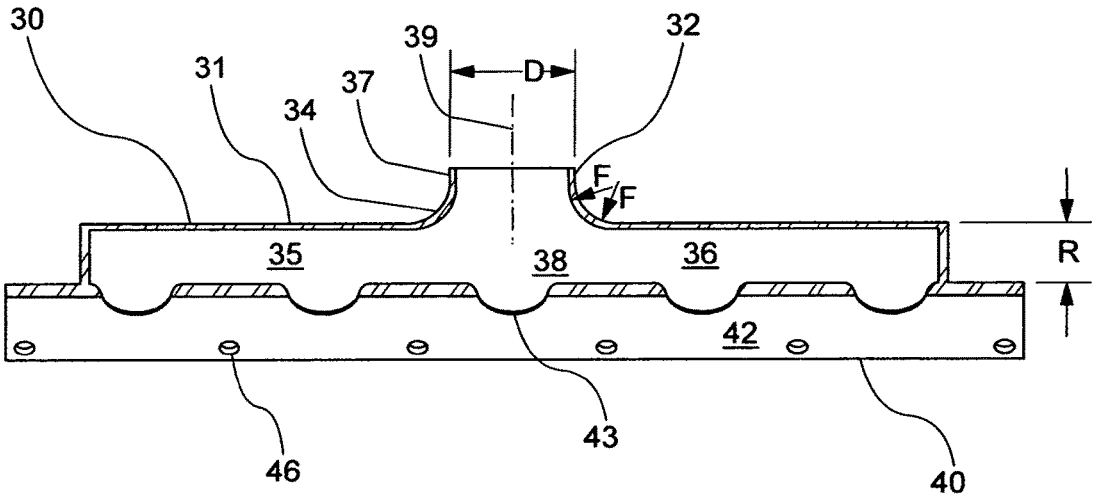
FIG. 10F schematically illustrates cross-section F-F of the suction manifold of FIG. 10D.

FIG. 10F illustrates cross section F-F of FIG. 10D. FIG. 10F again illustrates the relationship between outside diameter D of exterior cylindrical surface 37 of exterior intake connection 32 and radius R of exterior hemi-cylindrical surface 31 of lateral branches 35 and 36 of interior chamber 38. Interior and exterior radii F of fillet 34 are substantially equal. Fillet 34 radius F is always less than radius R of hemi-cylindrical exterior surfaces 31 of lateral arm 35 and 36; radius R should be maximized to improve flow and reduce turbulence and fluid friction loss at the intersection-of lateral branches 35 and 36 with exterior intake connection 32 of interior section 38.

Figure 11A:
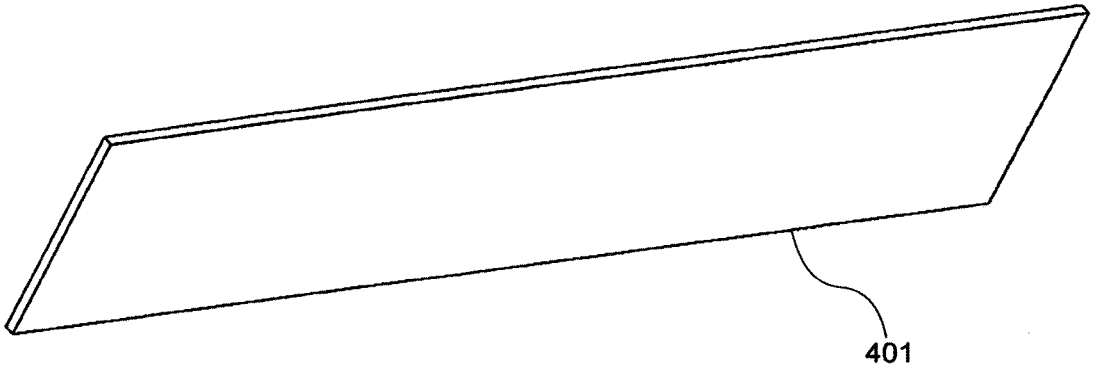
FIG. 11A schematically illustrates an orthogonal view of a commercially available steel plate cut into a rectangular shape for the mounting plate of the present invention.

FIGS. 11A-N illustrates a method of fabrication of the suction manifold 30 of the present invention. FIG. 11A orthogonally illustrates a commercially available steel plate 401 cut into a rectangular shape suitable for making mounting flange 40 of suction manifold 30 as illustrated in FIG. 10A.

Figure 11B:
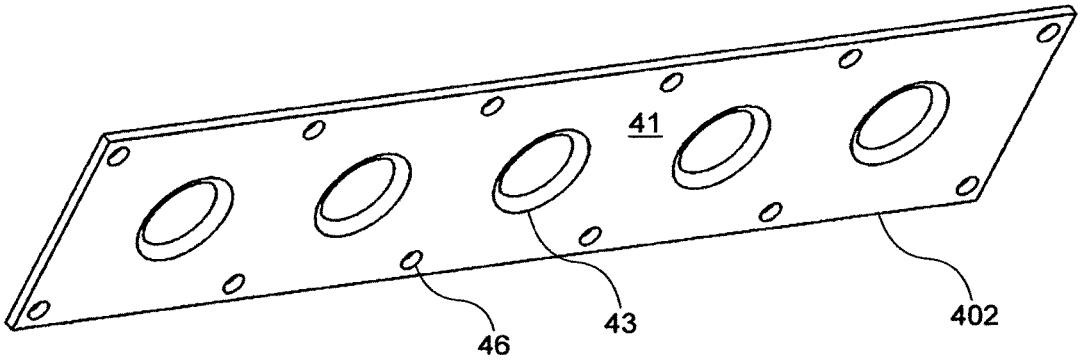
FIG. 11B schematically illustrates an orthogonal view of the mounting plate of FIG. 11A with holes cut for ports and bolting connections to the fluid end housing.

FIG. 11B orthogonally illustrates mounting plate 402, made from plate 401, with ports 43, bolt holes 46, and bottom surface 41.

Figure 11C:
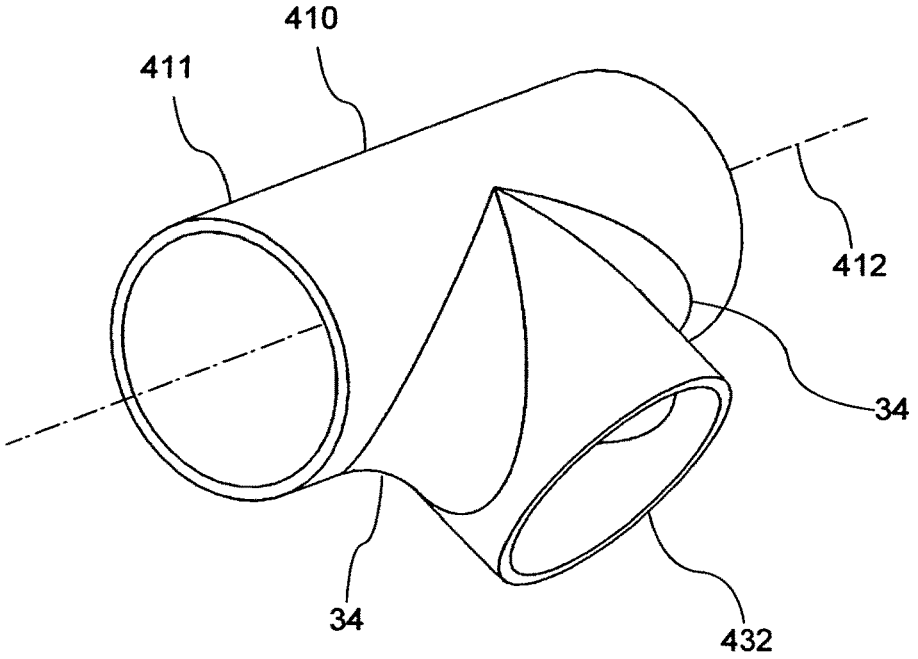
FIG. 11C schematically illustrates an orthogonal view of a commercially available TEE pipe fitting utilized in the construction of the suction manifold of the present invention.

FIG. 11C orthogonally illustrates a commercially available steel TEE pipe fitting 410. TEE pipe fittings 410 consists of a tubular section 411 with centerline 412 and a second tubular section 432 that will become external intake connection 32 in the finished suction manifold 30. Intersections of tubular sections 411 and 432 are transitioned with fillets 34.

Figure 11D:
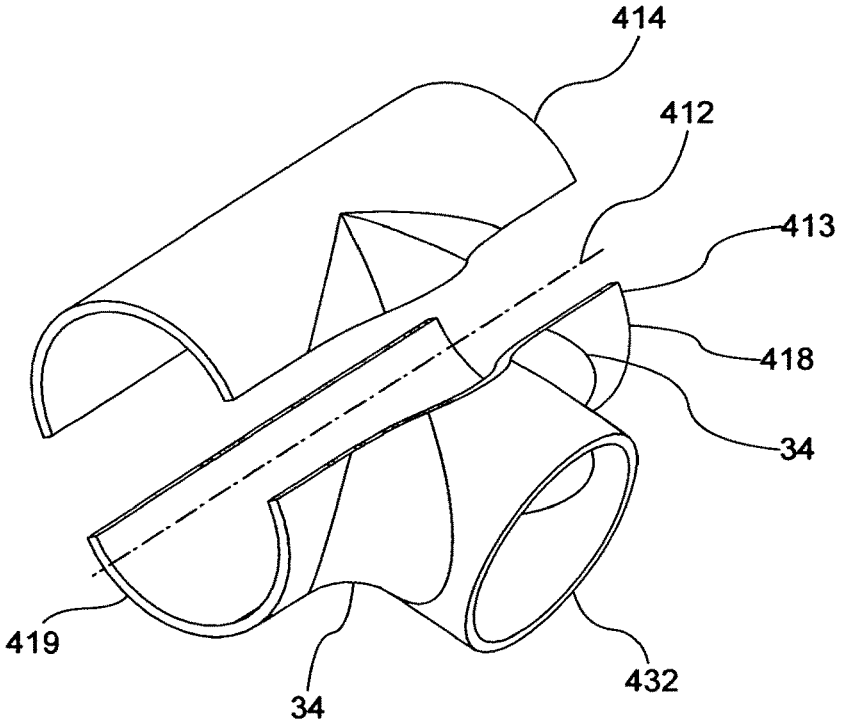
FIG. 11D schematically illustrates an orthogonal view of the TEE pipe fitting in FIG. 11A split into two pieces.

FIG. 11D illustrates TEE pipe fitting 410 split into pieces by a plane parallel to centerline 412. After TEE pipe fitting is split, two pieces remain: 413 and 414. Piece 413 contains tubular external intake connection 432 of TEE pipe fitting 410. TEE pipe fitting 410 is split in a plane at an angle corresponding with obtuse angle A of FIG. 10D. End surfaces 418 and 419 define the opposite ends of split TEE pipe fitting 413. Remaining piece 414 is discarded.

Figure 11E:
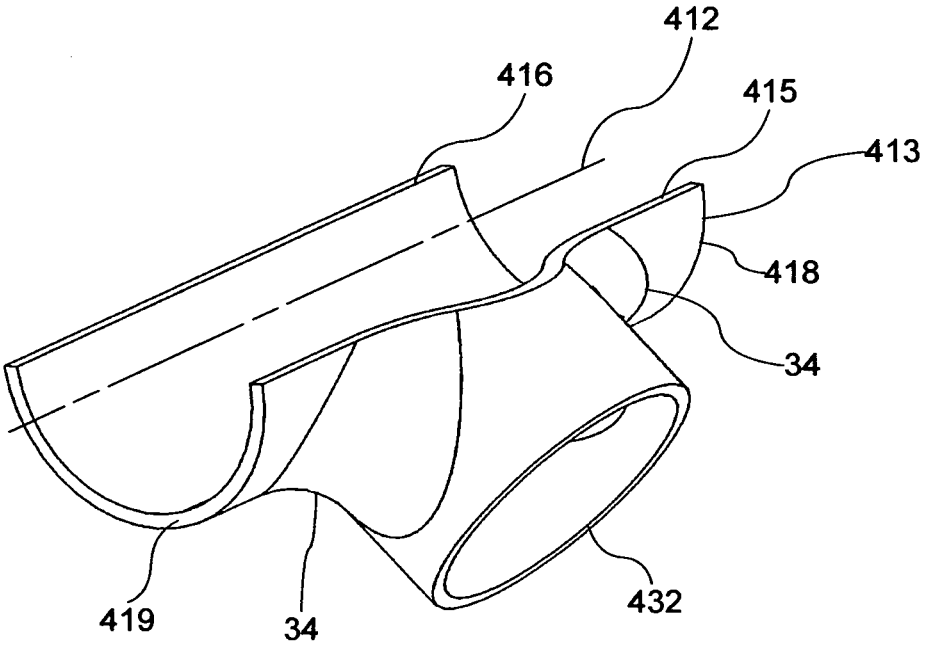
FIG. 11E schematically illustrates an orthogonal view of the retained piece of the TEE pipe fitting in FIG. 11B.

FIG. 11E orthogonally illustrates split piece 413 of FIG. 11D wherein split results in planar surfaces 415 and 416 of piece 413. Surfaces 415 and 416 are substantially co-planar with centerline 412.

Figure 11F:
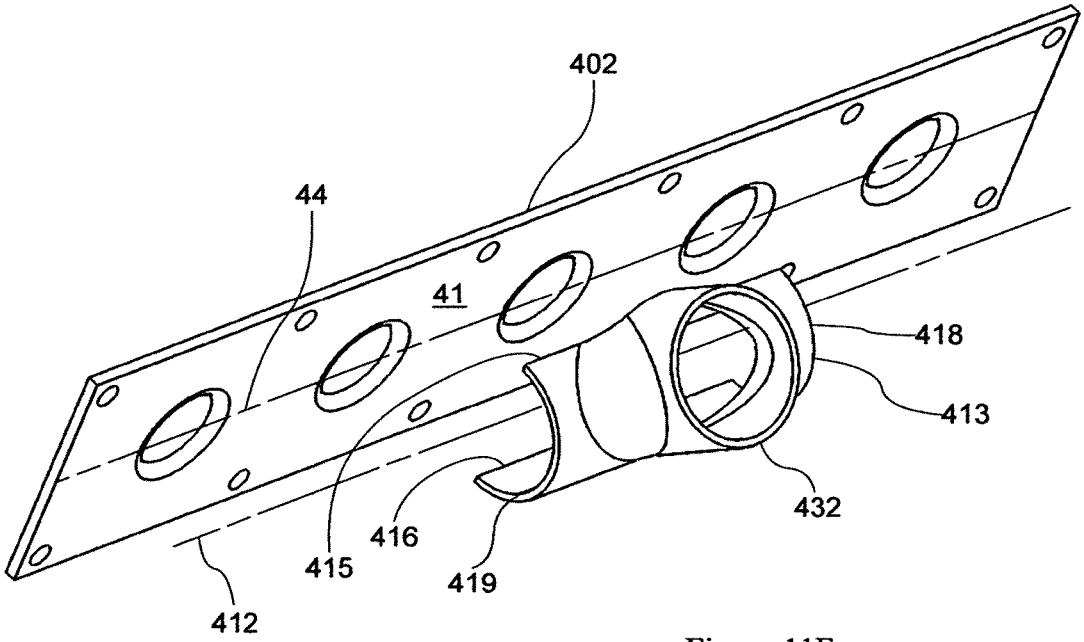
FIG. 11F schematically illustrates an orthogonal view of the cut piece of the TEE pipe fitting in FIG. 11E aligned with the mounting plate of FIG. 11B prior to welding.

FIG. 11F orthogonally illustrates the mounting plate 402 of FIG. 11B and a piece of the split TEE pipe fitting 413 aligned prior to welding. Centerlines 412 and 44 are parallel; surfaces 415 and 416 of split TEE pipe fitting and bottom surface 41 of the mounting plate 402 are also parallel in this configuration. End surfaces 418 and 419 of split TEE pipe fitting 413 are perpendicular to bottom surface 41 of mounting plate 402.

Figure 11G:
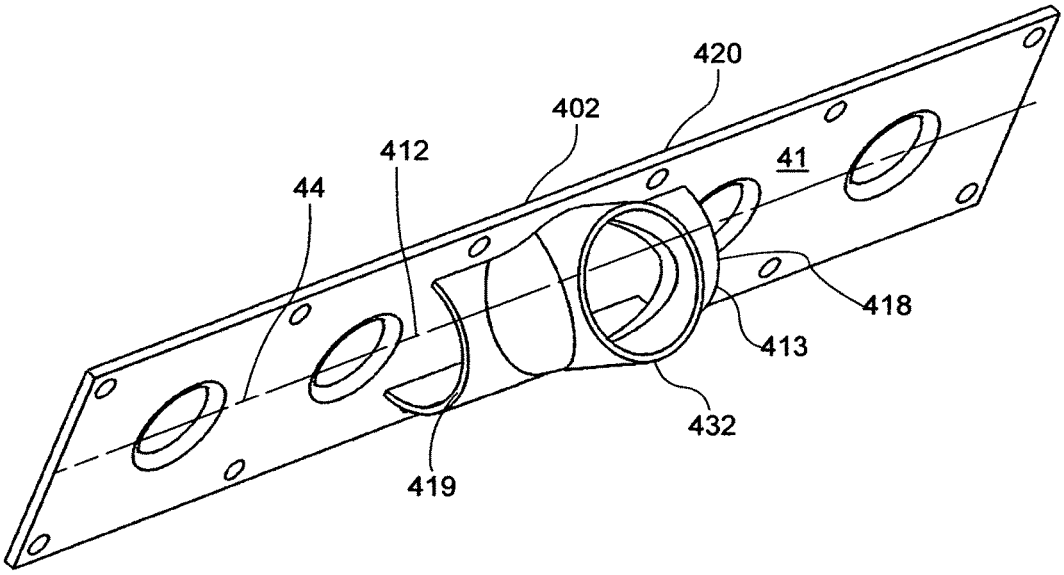
FIG. 11G schematically illustrates an orthogonal view of the finished weldment of the aligned pieces of FIG. 11F.

FIG. 11G orthogonally illustrates fabricated piece 420 after welding of mounting plate 402 to TEE split pipe fitting 413 of FIG. 11F. Centerlines 44 and 412 are now co-linear; surfaces 415 and 416 of split TEE pipe fitting are now coincident with bottom surface 41 of mounting flange 402 after being joined by welding.

Figure 11H:
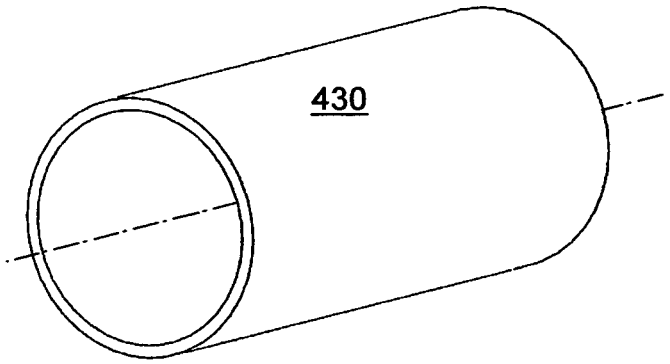
FIG. 11H schematically illustrates an orthogonal view of a piece of commercial available pipe.

FIG. 11H orthogonally illustrates a piece 430 of commercially available pipe of a pipe size and wall thickness substantially equal to tubular size and wall thickness of TEE pipe fitting of FIGS. 11C and 11D.

Figure 11I:
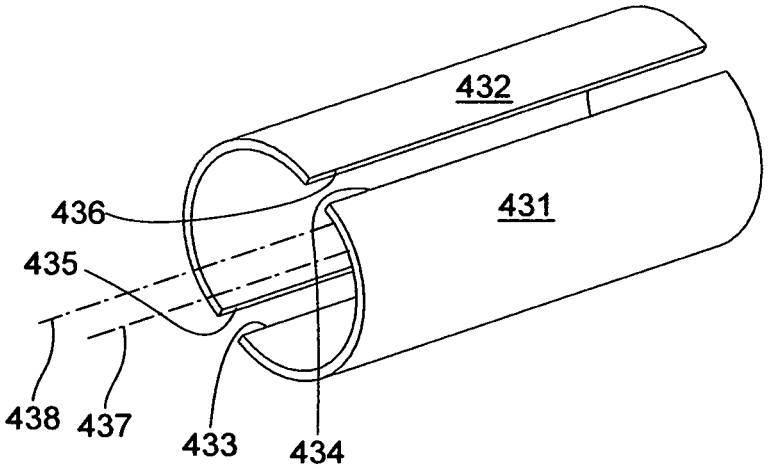
FIG. 11I schematically illustrates an orthogonal view of the pipe of FIG. 11H after spitting said pipe into two hemi-tubular pieces.

FIG. 11I orthogonally illustrates pipe piece 430 of FIG. 11H split into substantially equal hemi-tubular pieces 431 and 432 with centerlines 437 and 438 respectively. Planar surfaces 433 and 434 and centerline 437 of hemi-tubular piece 431 are substantially co-planar; similarly planar surfaces 435 and 436 and centerline 438 of hemi-tubular piece 432 are also substantially co-planar.

Figure 11J:
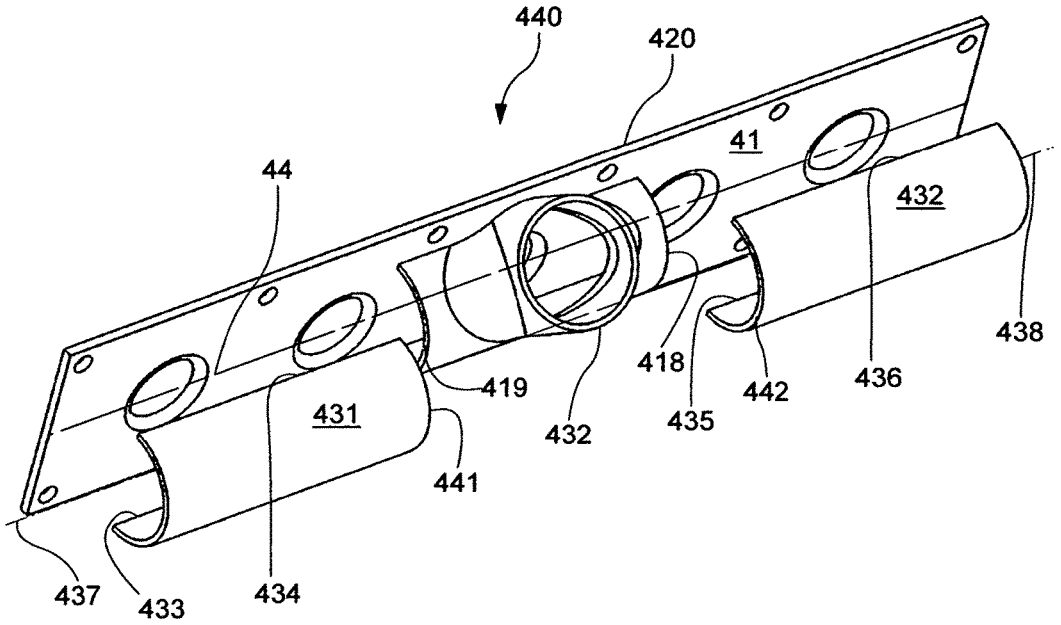
FIG. 11J schematically illustrates an orthogonal view of the weldment of FIG. 11G aligned with the split pieces of pipe of FIG. 11I prior to welding.

FIG. 11J orthogonally illustrates the alignment of fabrication piece 420 of FIG. 11G with hemi-tubular pieces 431 and 432 of FIG. 11I prior to welding to form welded fabrication 440. Centerlines 437 of hemi-tubular piece 431, 438 of hemi-tubular piece 432, and 44 are parallel; surfaces 433 and 434 of hemi-tubular pipe piece 431, surfaces 435 and 436 of hemi-tubular pipe piece 432 and bottom surface 41 of the mounting plate 402 are also parallel in this configuration. Additionally, end surface 441 of hemi-tubular piece 431 is parallel with end surface 419 of split TEE pipe fitting 413 of FIG. 11F and end surface 442 of hemi-tubular piece 432 is parallel with end surface 418, also of split TEE pipe fitting 413.

Figure 11K:
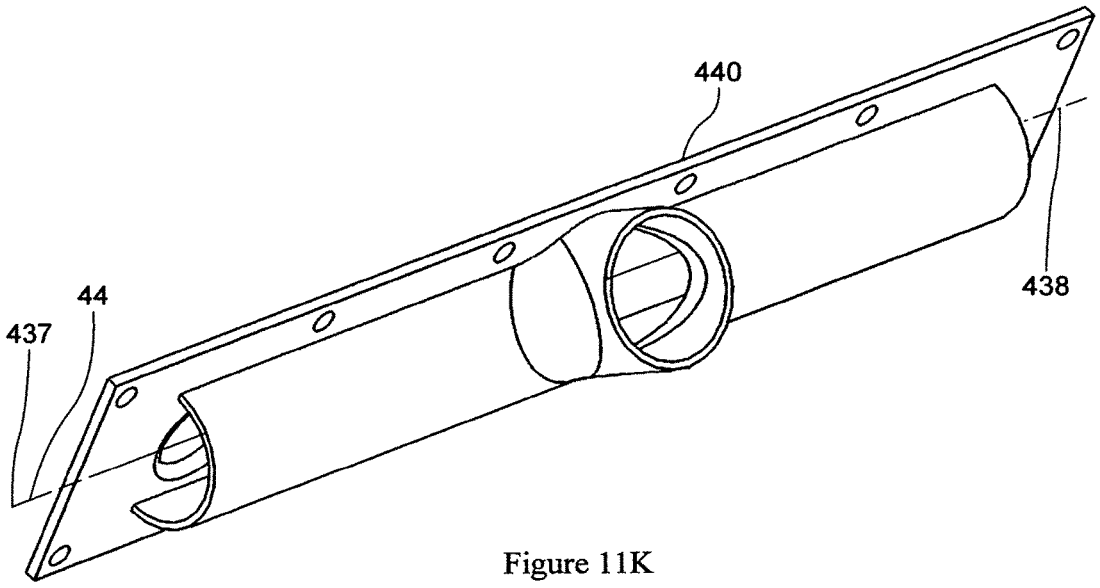
FIG. 11K schematically illustrates an orthogonal view of the finished weldment of the aligned pieces of FIG. 11J.

FIG. 11K orthogonally illustrates fabricated weldment 440, wherein surfaces 433 and 434 of hemi-tubular piece 431 are welded to bottom surface 41 of fabricated weldment 420, surfaces 435 and 436 of hemi-tubular piece 432 are welded to bottom surface 41 of fabricated weldment 420. End surface 441 of hemi-tubular piece 431 is welded to end surface 419 of weldment 420 and end surface 442 of hemi-tubular piece 432 is welded to end surface 418 of weldment 420. Centerlines 437, 438, and 44 are now substantially co-linear.

Figure 11L:
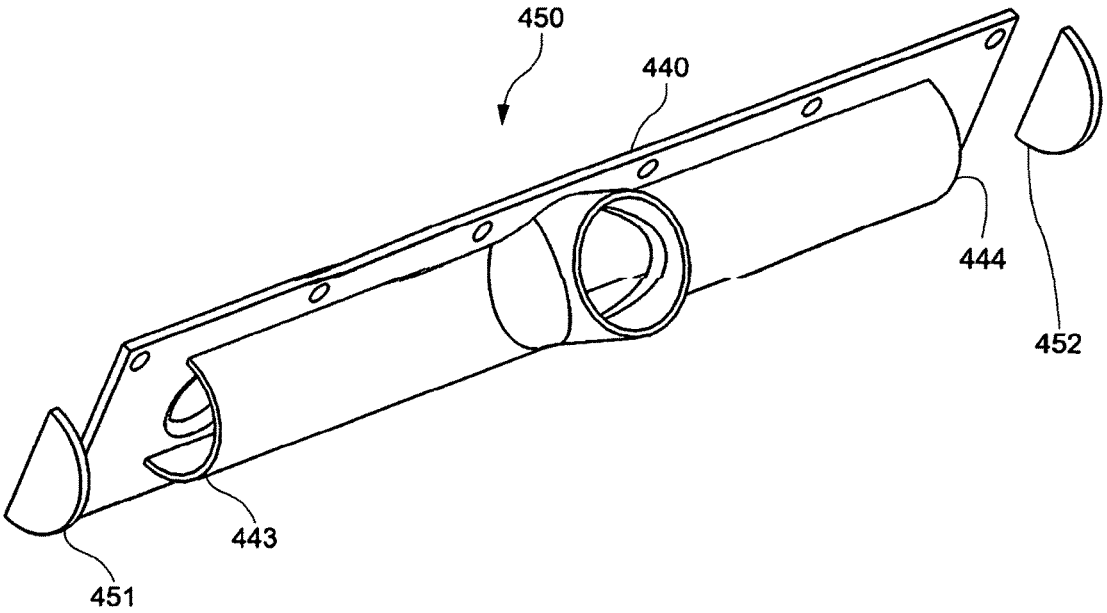
FIG. 11L schematically illustrates an orthogonal view of the finished weldment of FIG. 11K and two pieces of end cap aligned prior to weldment.

FIG. 11L orthogonally illustrates the alignment of fabrication piece 440 of FIG. 11K with end cap pieces 451 and 452 prior to welding of respective end caps to surfaces 443 and 444 respectively of welded fabrication piece 440 to form welded fabrication 450.

Figure 11M:
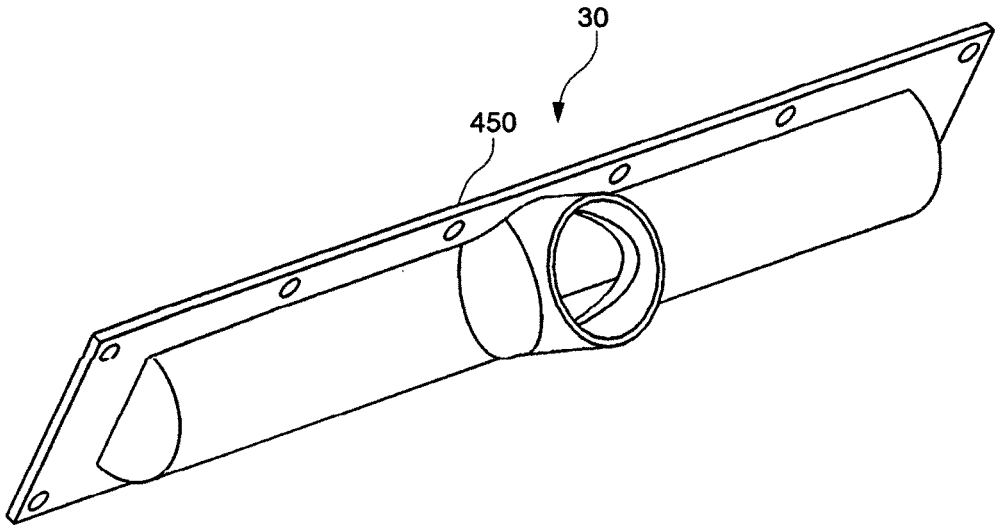
FIG. 11M schematically illustrates an orthogonal view of the finished weldment of FIG. 11L and the finished manifold of the present invention.

FIG. 11M orthogonally illustrates fabricated weldment 450 of FIG. 11L to form finished suction manifold 30 functionally similar to FIG. 10 of the present invention.

The invention claimed is:

1. A pump fluid end comprising:

a suction manifold optimized for preserving fluid energy, said suction manifold being located immediately below a plurality of suction valves in said pump fluid end, a plurality of individual ports equal to the number of individual suction valves in said plurality of suction valves, wherein each individual port in said plurality of ports feeds directly from an interior chamber of said manifold into a corresponding suction valve bore without connecting ducts between said individual ports and said interior chamber of said manifold, wherein said manifold comprises a flat top surface defining a mounting flange, wherein said plurality of individual ports pass through said mounting flange;

wherein a centerline of an external intake connection of said manifold is located substantially equal distance from the centerlines of the furthermost distal ports of the plurality of individual ports on either end of said manifold;

wherein the interior chamber of said manifold comprises first and second opposing lateral branches, wherein the inner and outer surfaces at the intersections of said lateral branches of said manifold and the external intake connection of said manifold are filleted, and wherein the angle between the centerline of the external intake connection and the plane formed by the centerlines of the plurality of individual ports of said manifold is an obtuse angle.

2. The pump fluid end of claim 1 wherein the obtuse angle between the centerline of the external intake connection and the plane formed by the centerlines of the various ports of said manifold ranges between 120 and 160 degrees.

3. The pump fluid end of claim 1 wherein the radius of a fillet radius at the intersection of said first and second lateral branches of the interior chamber and the external intake connection of said manifold ranges between 10 and 30 percent of the outside diameter of the external intake connection of said manifold.

4. The pump fluid end of claim 1 wherein the distance from the top surface of the mounting flange to the bottom surface of said first and second lateral branches of said suction manifold is less than the outside diameter of the external intake connection of said manifold.

5. The pump fluid end of claim 1 wherein the centerline of the external intake connection is substantially perpendicular to a centerline connecting the centers of said plurality of individual ports in said mounting flange.

6. The pump fluid end of claim 1 wherein said external intake connection is tubular in form.

7. The pump fluid end of claim 1 wherein said first and second lateral branches of said manifold are hemi-tubular in form.

8. The pump fluid end of claim 1 wherein the radii of the outside surfaces of the external intake connection and the radii of said first and second opposing lateral branches of said manifold are substantially equal.

9. The pump fluid end of claim 1 wherein the wall thicknesses of the external intake connection and the wall thicknesses of said and second opposing lateral branches of said manifold are substantially equal.

10. The pump fluid end of claim 7 wherein the centerlines of the two hemi-tubular lateral branches of said manifold are substantially co-linear and coincident with the bottom surface of said mounting plate.

11. A pump fluid end, comprising:

a plurality of suction valves;

a suction manifold comprising an interior chamber further comprising first and second opposing lateral branches and said suction manifold being located immediately below said plurality of suction valves;

wherein said suction manifold comprises a plurality of ports and wherein the number of ports in said plurality of ports is equal to the number of suction valves in said plurality of suction valves;

wherein each port in said plurality of ports feeds directly from an interior chamber of said suction manifold into a respective bore for each suction valve in said plurality of suction valves;

wherein said manifold comprises a flat top surface defining a mounting flange;

wherein said mounting flange is in direct fluid communication with said interior chamber of said suction manifold;

wherein each port in said plurality of ports between said suction valves and said manifold interior chamber is wholly contained within said mounting flange;

wherein the centerline of an external intake connection is located substantially equal distance from the centerlines of the furthermost distal ports of the plurality of ports on either end of said manifold;

wherein the intersection of said first and second lateral branches of the interior chamber and the external intake connection of said manifold is filleted, and wherein the angle between a centerline of the external intake connection and the plane formed by the centerlines of the various ports of said manifold is an obtuse angle.

12. The fluid end of claim 11 wherein the obtuse angle between centerline of the external intake connection and the plane formed by the centerlines of the various ports of said manifold ranges between 120 and 160 degrees.

13. The fluid end of claim 11 wherein the radius of said fillet at the intersection of the lateral branches enclosing said interior chamber and the external intake connection of said manifold ranges between 10 and 30 percent of the outside diameter of the external intake connection of said manifold.

14. The fluid end of claim 11 wherein the distance from the top surface of the mounting flange to the bottom surface of said first and second lateral branches of said suction manifold is less than the outside diameter of the external intake connection of said manifold.

15. The fluid end of claim 11 wherein the centerline of the external intake connection is substantially perpendicular to a centerline connecting the centers of said individual ports in said mounting flange.

* * * * *